US009561667B2

(12) United States Patent
Yoshida

(10) Patent No.: US 9,561,667 B2
(45) Date of Patent: Feb. 7, 2017

(54) PRINTER AND COMPUTER-READABLE STORAGE MEDIUM FOR EXECUTING PARTIAL MULTI-PASS PRINTING

(71) Applicant: BROTHER KOGYO KABUSHIKI KAISHA, Nagoya-shi, Aichi-ken (JP)

(72) Inventor: Yasunari Yoshida, Aichi-ken (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/045,706

(22) Filed: Feb. 17, 2016

(65) Prior Publication Data

US 2016/0243862 A1 Aug. 25, 2016

(30) Foreign Application Priority Data

Feb. 20, 2015 (JP) ..... 2015-031609

(51) Int. Cl.
*B41J 29/38* (2006.01)
*B41J 2/21* (2006.01)

(52) U.S. Cl.
CPC ..... *B41J 2/2132* (2013.01)

(58) Field of Classification Search
CPC ..... B41J 2/2132; B41J 29/393; B41J 2/2139; B41J 29/38; B41J 2/2135; B41J 2/04595; B41J 2/04501; B41J 2/04526; B41J 25/001
USPC ..... 347/5, 9, 12, 14, 16, 19, 20, 37, 40, 101
See application file for complete search history.

(56) References Cited

U.S. PATENT DOCUMENTS

| | | | | |
|---|---|---|---|---|
| 5,847,721 | A | 12/1998 | Ogata et al. | |
| 2006/0044333 | A1 | 3/2006 | Nishikori et al. | |
| 2007/0057996 | A1 | 3/2007 | Yazawa et al. | |
| 2014/0085371 | A1* | 3/2014 | Ebisawa | B41J 2/04501 347/14 |

(Continued)

FOREIGN PATENT DOCUMENTS

| | | | |
|---|---|---|---|
| JP | 8-244253 | A | 9/1996 |
| JP | 2006-76029 | A | 3/2006 |

(Continued)

OTHER PUBLICATIONS

Related U.S. Appl. No. 15/045,450, filed Feb. 17, 2016.

(Continued)

*Primary Examiner* — Jannelle M Lebron
(74) *Attorney, Agent, or Firm* — Merchant & Gould P.C.

(57) ABSTRACT

A printer performs a partial multi-pass printing including an (a)-print process and a (b)-print process. The (a)-print process includes an (a1)-pass process and a (a2)-pass process executed between the (a1)-pass process and the (b)-print process. The (a2)-pass process is a last pass process executed in the (a)-print process. Active nozzles used in the (a1)-pass process and the (a2)-pass process include an upstream segment and a downstream segment, an intermediate segment between the upstream segment and the downstream segment. Dot recording rates of active nozzles included in the upstream segment used in the (a2)-pass process decreases toward the most-upstream nozzle of the active nozzles. The upstream segment of the (a2)-pass process has a length in a conveying direction smaller than a length of an upstream segment of active nozzles used in the (a1)-pass process.

9 Claims, 13 Drawing Sheets

(56) References Cited

U.S. PATENT DOCUMENTS

| | | | | |
|---|---|---|---|---|
| 2014/0292867 | A1* | 10/2014 | Takata | B41J 2/04563 347/14 |
| 2015/0035891 | A1 | 2/2015 | Yoshida et al. | |
| 2016/0243821 | A1 | 8/2016 | Yoshida | |
| 2016/0243822 | A1 | 8/2016 | Yoshida | |

FOREIGN PATENT DOCUMENTS

| | | | |
|---|---|---|---|
| JP | 2006-96031 | A | 4/2006 |
| JP | 2007-185941 | A | 7/2007 |
| JP | 2015-030149 | A | 2/2015 |

OTHER PUBLICATIONS

Related U.S. Appl. No. 15/045,604, filed Feb. 17, 2016.
Office Action issued in related U.S. Appl. No. 15/045,604, Sep. 27, 2016.

* cited by examiner

PRINTER AND COMPUTER-READABLE STORAGE MEDIUM FOR EXECUTING PARTIAL MULTI-PASS PRINTING

CROSS REFERENCE TO RELATED APPLICATION

This application claims priority from Japanese Patent Application No. 2015-031609 filed Feb. 20, 2015. The entire content of the priority application is incorporated herein by reference. The present application is closely related to a co-pending U.S. Patent Application corresponding to Japanese Patent Application No. 2015-031594 filed Feb. 20, 2015 and a co-pending U.S. Patent Application corresponding to Japanese Patent application No 2015-031599 filed Feb. 20, 2015.

TECHNICAL FIELD

The present disclosure relates to a printer, a print control apparatus and a method for controlling a print execution unit to execute a printing operation. The print execution unit includes a conveying mechanism that conveys sheets of paper in a conveying direction, and a print head having a plurality of nozzles arranged in the conveying direction.

BACKGROUND

A printer known in the art performs a printing operation by ejecting ink from a plurality of nozzles formed in a print head onto a sheet of paper while executing a main scan to move the print head in a main scanning direction. In one main scan, this printer forms dots in ink within a band-like area. A technique for overlapping the edge portions of two neighboring bands has been proposed in order to avoid producing white lines and uneven densities at the border between the bands. Another technique was proposed for modifying the dot recording rates for nozzles based on the nozzle positions in the paper-conveying direction. In this technique, the device sets the recording rate to the maximum value for nozzles positioned near the center in the conveying direction and reduces the recording rate for nozzles to a larger degree the closer they are positioned near the ends of the nozzle rows in the conveying direction. Further, a technique was proposed to reduce the number of nozzles used in one main scan (i.e., to decrease the width of the band) on the leading and trailing edges of the sheet with the knowledge that dot positioning precision is more unstable when printing the leading and trailing edges of sheets.

SUMMARY

However, this conventional technique does not go far enough in considering the best way to overlap edges of two adjacent bands while modifying the dot recording rates based on nozzle positions in the conveying direction.

In view of the foregoing, it is an object of the present disclosure to provide a technique for appropriately overlapping edge portions of two adjacent bands formed in two main scans while using non-uniform dot recording rates that are varied according to the nozzle positions in the conveying direction.

In order to attain the above and other objects, the disclosure provides a printer including a print executing unit and a controller. The print executing unit includes a conveying mechanism, a print head, and a main scanning mechanism. The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The controller is configured to control the print executing unit to perform a multi-pass printing for printing a target image on the sheet with a plurality of pass processes. The plurality of pass processes forms a plurality of partial images respectively. Two partial images formed with successive two pass processes overlap partially. K number of active nozzles consecutively arranged are selected from the plurality of nozzles for each of the plurality of pass processes. The controller is further configured to control the print executing unit to perform: an (a)-print process in which the conveying mechanism conveys the sheet and at least two pass processes are executed with Ka number of active nozzles, wherein the at least two pass processes include: an (a1)-pass process with Ka1 number of active nozzles as the Ka number of active nozzles, the Ka1 number of active nozzles including a first upstream segment, a first downstream segment, and a first intermediate segment between the first upstream segment and the first downstream segment in the conveying direction, the first upstream segment including a most-upstream nozzle of the Ka1 number of active nozzles in the conveying direction, the first downstream segment including a most-downstream nozzle of the Ka1 number of active nozzles in the conveying direction, dot recording rates of active nozzles included in the first upstream segment decreasing from a most-downstream nozzle of the first upstream segment toward the most-upstream nozzle of the Ka1 number of active nozzles, the first downstream segment having a length same as a length of the first upstream segment, dot recording rates of active nozzles included in the first downstream segment decreasing from a most-upstream nozzle of the first downstream segment toward the most-downstream nozzle of the Ka1 number of active nozzles, and dot recording rate of each active nozzle included in the first intermediate segment being 100%; and an (a2)-pass process with Ka2 number of active nozzles as the Ka number of active nozzles, the (a2)-pass process being a last pass process executed in the (a)-print process and executed after the (a1)-pass process, the Ka2 number of active nozzles including a second upstream segment, a second downstream segment, and a second intermediate segment between the second upstream segment and the second downstream segment in the conveying direction, the second upstream segment including a most-upstream nozzle of the Ka2 number of active nozzles in the conveying direction, the second downstream segment including a most-downstream nozzle of the Ka2 number of active nozzles in the conveying direction, dot recording rates of active nozzles included in the second upstream segment decreasing from a most-downstream nozzle of the second upstream segment toward the most-upstream nozzle of the Ka2 number of active nozzles, dot recording rates of active nozzles included in the second downstream segment decreasing from a most-upstream nozzle of the second downstream segment toward the most-downstream nozzle of the Ka2 number of active nozzles, the second downstream segment of the Ka2 number of active nozzles having a length same as the length of the first upstream segment of the Ka1 number of active nozzles used in the (a1)-pass process, the second upstream segment of the Ka2 number of active nozzles having a length smaller than the length of the first upstream segment of the Ka1 number of active nozzles used in the (a1)-pass process, and dot recording rate of each active nozzle included in the second intermediate segment being 100%; and a (b)-print process in which the conveying mechanism conveys the sheet and executed with Kb number of active nozzles, the (b)-print process being executed after the (a2)-pass process, the Kb number of active nozzles including a third downstream segment including a most-downstream nozzle of the Kb number of active nozzles in the conveying direction, and dot recording rates of active nozzles included in the third downstream segment decreasing from a most-upstream nozzle of the third downstream segment toward the most-downstream nozzle of the Kb number of active nozzles. K denotes the number of active nozzles selected from the plurality of nozzles and is an integer greater than or equal to 2. Similarly, Ka, Ka1, Ka2, and Kb, denote the number of active nozzles used in respective processes.

According to another aspect, the present disclosure provides a non-transitory computer readable storage medium storing a set of program instructions executable by a processor. The program instructions, when executed by the processor, cause the processor to control a print executing apparatus to perform a multi-pass printing. The print executing apparatus includes a conveying mechanism, a print head, and a main scanning mechanism. The conveying mechanism is configured to convey a sheet in a conveying direction. The print head has a plurality of nozzles arranged in the conveying direction. Each of the plurality of nozzles is configured to eject an ink droplet to form a dot on the sheet. The main scanning mechanism is configured to execute a main scan by moving the print head in a main scanning direction perpendicular to the conveying direction. The processor is configured to control the print executing apparatus to perform the multi-pass printing for printing a target image on the sheet with a plurality of pass processes. The plurality of pass processes forms a plurality of partial images respectively. Two partial images formed with successive two pass processes overlap partially. K number of active nozzles consecutively arranged are selected from the plurality of nozzles for each of the plurality of pass processes. The controller is further configured to control the print executing unit to perform: an (a)-print process in which the conveying mechanism conveys the sheet and at least two pass processes are executed with Ka number of active nozzles, wherein the at least two pass processes include: an (a1)-pass process with Ka1 number of active nozzles as the Ka number of active nozzles, the Ka1 number of active nozzles including a first upstream segment, a first downstream segment, and a first intermediate segment between the first upstream segment and the first downstream segment in the conveying direction, the first upstream segment including a most-upstream nozzle of the Ka1 number of active nozzles in the conveying direction, the first downstream segment including a most-downstream nozzle of the Ka1 number of active nozzles in the conveying direction, dot recording rates of active nozzles included in the first upstream segment decreasing from a most-downstream nozzle of the first upstream segment toward the most-upstream nozzle of the Ka1 number of active nozzles, the first downstream segment having a length same as a length of the first upstream segment, and dot recording rates of active nozzles included in the first downstream segment decreasing from a most-upstream nozzle of the first downstream segment toward the most-downstream nozzle of the Ka1 number of active nozzles, dot recording rate of each active nozzle included in the first intermediate segment being 100%; and an (a2)-pass process with Ka2 number of active nozzles as the Ka number of active nozzles, the (a2)-pass process being a last pass process executed in the (a)-print process and executed after the (a1)-pass process, the Ka2 number of active nozzles including a second upstream segment, a second downstream segment, and a second intermediate segment between the second upstream segment and the second downstream segment in the conveying direction, the second upstream segment including a most-upstream nozzle of the Ka2 number of active nozzles in the conveying direction, the second downstream segment including a most-downstream nozzle of the Ka2 number of active nozzles in the conveying direction, dot recording rates of active nozzles included in the second upstream segment decreasing from a most-downstream nozzle of the second upstream segment toward the most-upstream nozzle of the Ka2 number of active nozzles, dot recording rates of active nozzles included in the second downstream segment decreasing from a most-upstream nozzle of the second downstream segment toward the most-downstream nozzle of the Ka2 number of active nozzles having a length same as the length of the first upstream segment of the Ka1 number of active nozzles used in the (a1)-pass process, and the second upstream segment of the Ka2 number of active nozzles having a length smaller than the length of the first upstream segment of the Ka1 number of active nozzles used in the (a1)-pass process, and dot recording rate of each active nozzle included in the second intermediate segment being 100%; and a (b)-print process in which the conveying mechanism conveys the sheet and executed with Kb number of active nozzles, the (b)-print process being executed after the (a2)-pass process, the Kb number of active nozzles including a third downstream segment including a most-downstream nozzle of the Kb number of active nozzles in the conveying direction, and dot recording rates of active nozzles included in the third downstream segment decreasing from a most-upstream nozzle of the third downstream segment toward the most-downstream nozzle of the Kb number of active nozzles.

BRIEF DESCRIPTION OF THE DRAWINGS

The particular features and advantages of the disclosures as well as other objects will become apparent from the following description taken in connection with the accompanying drawings, in which.

DETAILED DESCRIPTION

A. First Embodiment

A-1. Structure of a Printing Device

Figure 1:
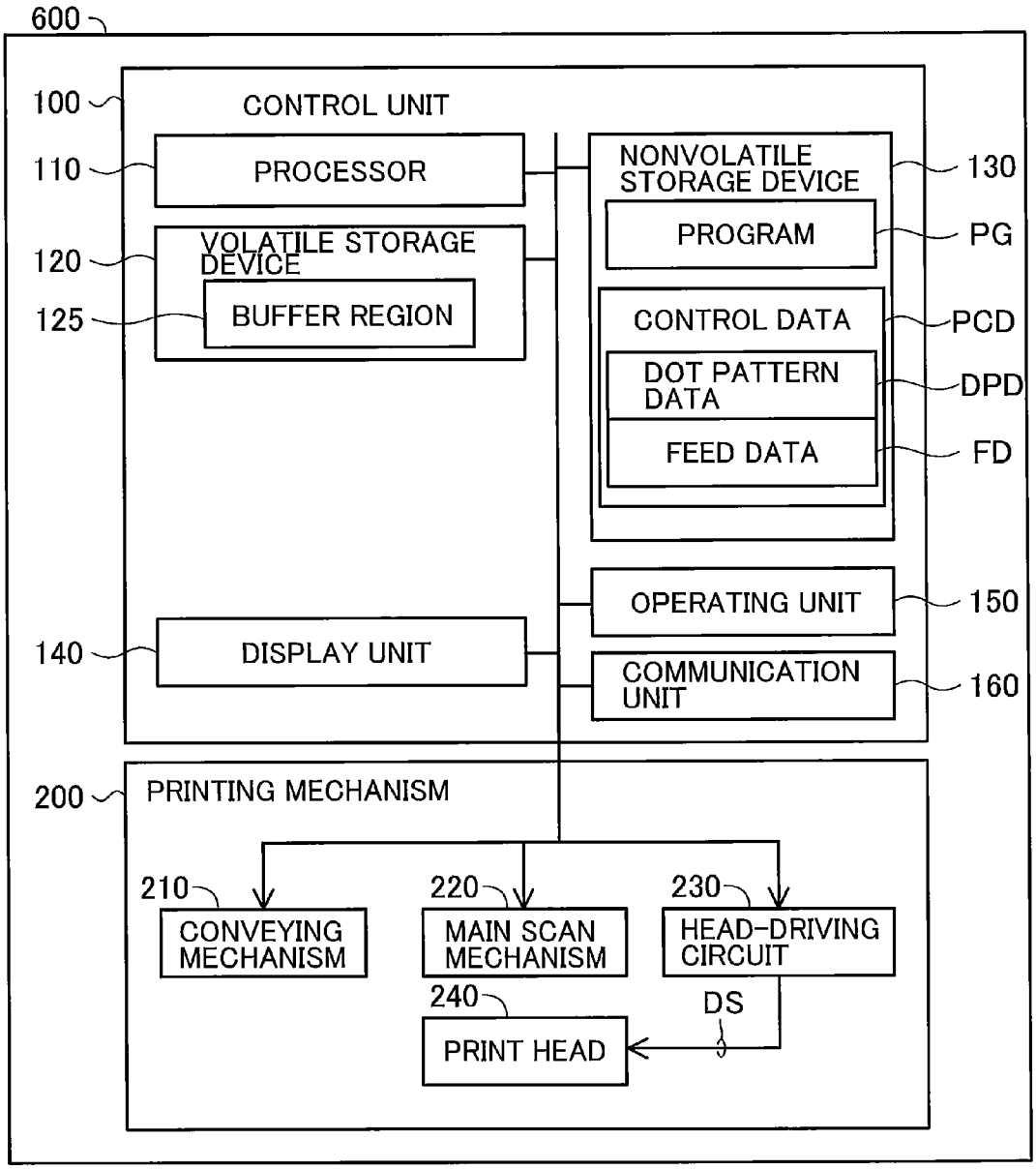
FIG. 1 is a block diagram showing a structure of a printer according to embodiments.

FIG. 1 is a block diagram showing the structure of a printer 600 according to a first embodiment. The printer 600 is an inkjet printer that prints images on sheets of paper by forming dots on the paper with ink. The printer 600 includes a control unit 100 for controlling all operations of the printer 600, and a printing mechanism 200 serving as a print executing unit.

The control unit 100 includes a processor 110 functioning as a controller, such as CPU; a volatile storage device 120, such as DRAM; a nonvolatile storage device 130, such as flash memory or a hard disk drive; a display unit 140, such as a liquid crystal display; an operating unit 150, such as a touchscreen superimposed on a liquid crystal display panel and various buttons; and a communication unit 160 having a communication interface for communicating with external devices, such as a personal computer (not shown).

The volatile storage device 120 is provided with a buffer region 125 for temporarily storing various intermediate data generated when the processor 110 performs processes. The nonvolatile storage device 130 stores a computer program PG for controlling the printer 600, and control data PCD. The control data PCD includes basic dot pattern data DPD used in a print data generating process described later and feed data FD.

The computer program PG is pre-stored in the nonvolatile storage device 130 prior to shipping the printer 600. Note that the computer program PG may be supplied to the user on a DVD-ROM or other storage medium, or may be made available for download from a server. By executing the computer program PG, the CPU 110 implements a control process of the printer 600 described later. The control data PCD may be incorporated with the computer program PG or supplied together with the computer program PG.

The printing mechanism 200 executes printing operations by ejecting ink droplets in the colors cyan (C), magenta (M), yellow (Y), and black (K) under control of the processor 110 in the control unit 100. The printing mechanism 200 includes a conveying mechanism 210, a main scan mechanism 220, a head-driving circuit 230, and a print head 240. The conveying mechanism 210 is provided with a conveying motor (not shown) that produces a drive force for conveying sheets of paper along a prescribed conveying path. The main scan mechanism 220 is provided with a main scan motor (not shown) that produces a drive force for reciprocating the print head 240 in the main scanning direction (hereinafter also called a "main scan"). The head-driving circuit 230 provides a drive signal DS to the print head 240 for driving the print head 240 while the main scan mechanism 220 is moving the print head 240 in a main scan. The print head 240 forms dots on a sheet of paper conveyed by the conveying mechanism 210 by ejecting ink droplets according to the drive signal DS. In this description, the process of forming dots on paper while performing a main scan will be called a "pass process." The processor 110 of the control unit 100 executes printing by repeatedly controlling the printing mechanism 200 to execute a conveying process for conveying the sheet in the conveying direction with the conveying mechanism 210, and a pass process for forming dots on the sheet of paper with the main scan mechanism 220 and head-driving circuit 230.

Figure 2:
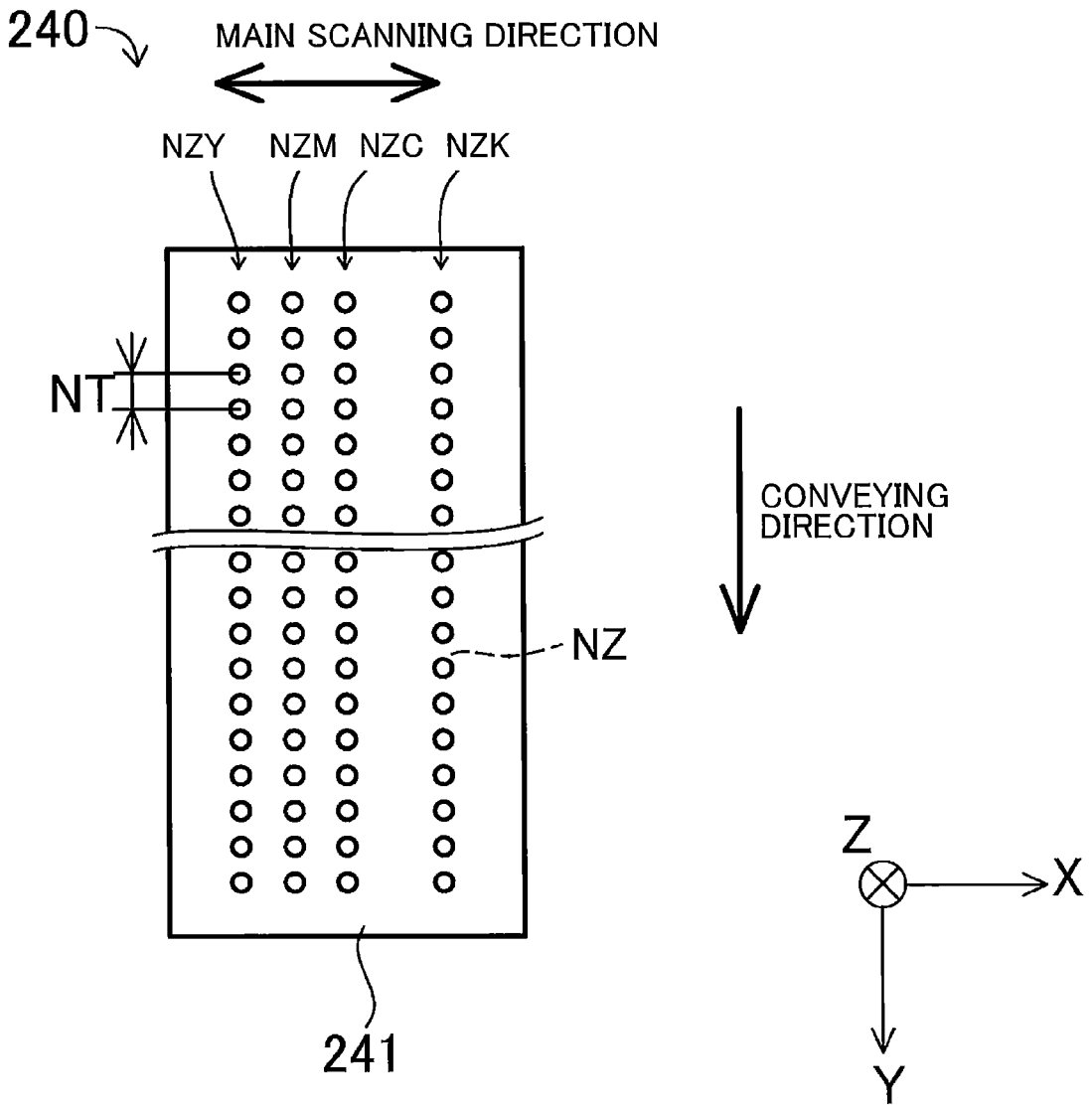
FIG. 2 shows a general structure of a print head of the printer.

FIG. 2 shows the general structure of the print head 240. As shown in FIG. 2, the print head 240 has a nozzle-forming surface 241 constituting the −Z side thereof. Nozzle rows NZC, NZM, NZY, and NZK for ejecting ink droplets in the respective colors C, M, Y, and K are formed in the nozzle-forming surface 241 of the print head 240. Each nozzle row includes a plurality of nozzles NZ arranged at different positions from one another relative to the conveying direction. The nozzle pitch NT in FIG. 2 denotes the distance in the conveying direction any two nozzles that are adjacent to each other in the conveying direction. The nozzles NZ in a single nozzle row are positioned at a uniform pitch in the conveying direction. The positions of the nozzles NZ in a single nozzle row relative to the main scanning direction may be identical or may be different. For example, the plurality of nozzles NZ may form a zigzag shape in the conveying direction. In FIG. 2 and subsequent drawings, the +Y direction denotes the sheet-conveying direction (sub scanning direction), the X direction (+X and −X directions) denotes the main scanning direction, and the +Z direction is a direction orthogonal to the Y direction and the X direction (the upward direction in this case). Hereinafter, the +Y side will be simply called the "downstream side," while the −Y side will be simply called the "upstream side."

Figure 3A:
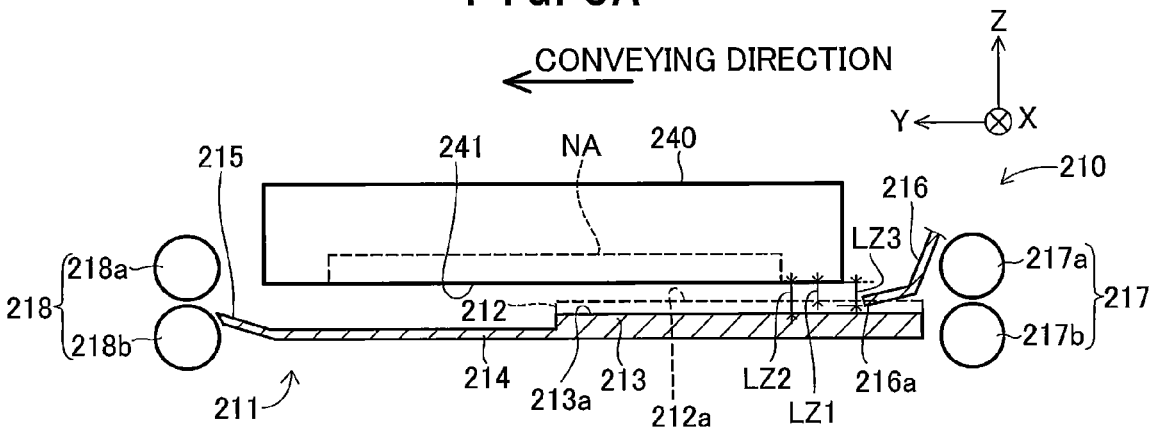
FIG. 3A shows a general structure of a conveying mechanism of the printer.
Figure 3B:
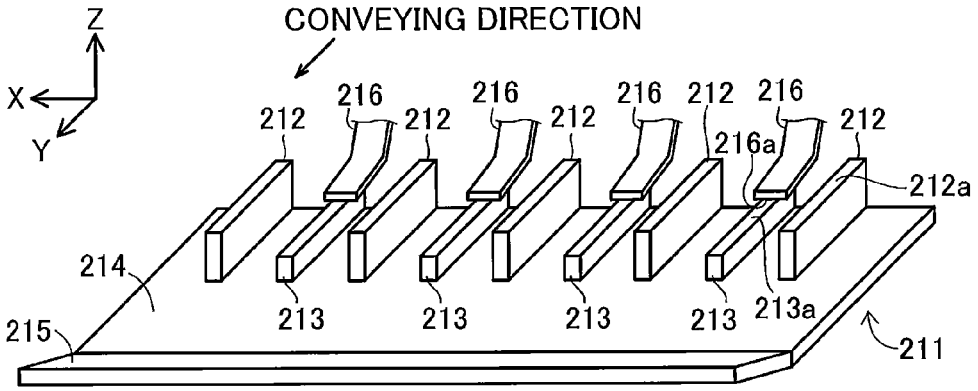
FIG. 3B is a perspective view of a sheet support and pressing members of the conveying mechanism when a sheet is not interposed between the sheet support and the pressing members.
Figure 3C:
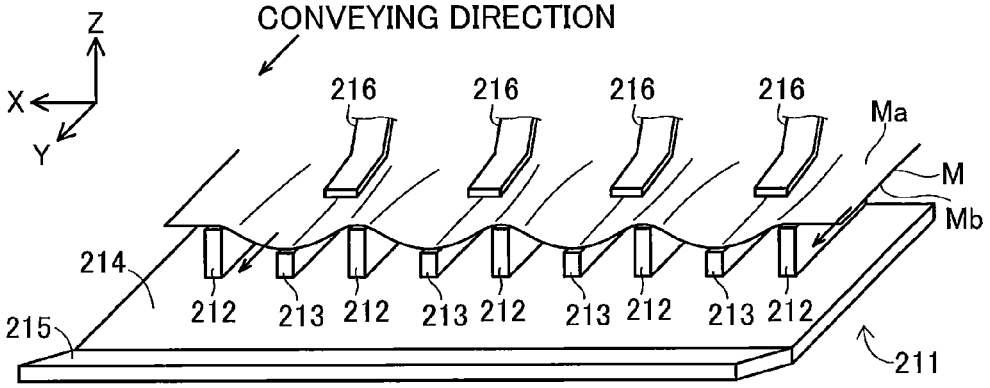
FIG. 3C is a perspective view of the sheet support and the pressing members when a sheet is interposed between the sheet support and the pressing members.

FIGS. 3A-3C show the general structure of the conveying mechanism 210. As shown in FIG. 3A, the conveying mechanism 210 includes a sheet support 211, a pair of upstream rollers 217 and a pair of downstream rollers 218 for holding and conveying sheets, and a plurality of pressing members 216. The print head 240 is disposed above (the +Z side) the sheet support 211.

The upstream rollers 217 are disposed on the upstream side (−Y side) of the print head 240 in the conveying direction, while the downstream rollers 218 are disposed on the downstream side (+Y side) of the print head 240. The upstream rollers 217 include a drive roller 217*a* and a follow roller 217*b*. The drive roller 217*a* is driven to rotate by a conveying motor (not shown). The follow roller 217*b* rotates along with the rotation of the drive roller 217*a*. Similarly, the downstream rollers 218 include a drive roller 218*a* and a follow roller 218*b*. Note that plate members may be employed in place of the follow rollers 217*b* and 218*b*, whereby sheets of paper are held between the drive rollers and corresponding plate members.

The sheet support 211 is disposed at a position between the upstream rollers 217 and the downstream rollers 218 and confronts the nozzle-forming surface 241 of the print head 240. The pressing members 216 are arranged between the upstream rollers 217 and the print head 240.

FIGS. 3B and 3C are perspective views of the sheet support 211 and the pressing members 216. FIG. 3B shows the components when a sheet M is not interposed between the pressing members 216 and sheet support 211, and FIG. 3C shows the components when a sheet M is interposed between the pressing members 216 and the sheet support 211. The sheet support 211 includes a plurality of high support members 212, a plurality of low support members 213, a flat plate 214, and a sloped part 215.

The flat plate 214 is a plate-shaped member that is arranged substantially parallel to the main scanning direction (X direction) and the conveying direction (+Y direction). The upstream edge (−Y side edge) of the flat plate 214 is positioned near the upstream rollers 217 and extends farther upstream (−Y side) than the upstream edge (−Y side edge) of the print head 240. The sloped part 215 is a plate-shaped member positioned on the downstream side (+Y side) of the flat plate 214 and slopes upward in the downstream direction (+Y direction). The downstream edge (+Y side edge) of the sloped part 215 is positioned near the downstream rollers 218 and extends farther downstream (+Y side) than the downstream edge (+Y side edge) of the print head 240. The dimension of the flat plate 214 in the X direction is longer than the dimension of a sheet M with a specific size in the X direction by a prescribed amount. Accordingly, when the printer 600 executes borderless printing for printing both edges of the sheet M relative to the X direction (main scanning direction) so that no margins remain on these edges, the flat plate 214 can receive ink ejected beyond the edges of the sheet M in the X direction.

The high support members 212 and low support members 213 are alternately arranged and spaced at intervals in the X direction. Thus, each of the low support members 213 is disposed between two high support members 212 neighboring the low support member 213. The high support members 212 are ribs that extend in the Y direction. The low support members 213 are ribs that extend in the Y direction and that are lower in profile than the high support members 212. The upstream (−Y) ends of the high support members 212 are aligned with the upstream edge of the flat plate 214, while the downstream (+Y) ends of the high support members 212 are positioned in the center region of the flat plate 214 with respect to the Y direction. The downstream ends of the high support members 212 may be said to be positioned in the approximate center of a region NA relative to the Y direction, where the region NA is the region of the print head 240 in which the nozzles NZ are formed. Hereinafter, the region NA in which the nozzles NZ are formed will be called the "nozzle area NA." The positions of both ends of the low support members 213 in the Y direction are identical to the same positions of the high support members 212 in the Y direction.

The pressing members 216 are disposed on the +Z side of the corresponding low support members 213 and at the same positions in the X direction as the low support members 213. In other words, each pressing member 216 is positioned between two high support members 212 neighboring the pressing member 216 in the X direction. The pressing members 216 are plate-shaped members that slope toward the low support members 213 in the downstream direction (+Y direction). The downstream ends (+Y side ends) of the pressing members 216 are positioned between the upstream edge (−Y side edge) of the print head 240 and the upstream rollers 217.

The pluralities of high support members 212, low support members 213, and pressing members 216 are positioned closer to the upstream rollers 217 than to the downstream rollers 218 and, hence, may be considered to be provided on the upstream rollers 217 side of the conveying mechanism 210 with respect to the upstream rollers 217 and downstream rollers 218.

As shown in FIG. 3C, a sheet M of paper conveyed by the conveying mechanism 210 has a printing surface Ma on which the print head 240 ejects ink droplets, and a back surface Mb on the opposite side of the printing surface Ma. As the sheet M is conveyed, the high support members 212 and the low support members 213 support the sheet M on the back surface Mb side and the pressing members 216 support the sheet M on the printing surface Ma side. The parts of the high support members 212 that support the sheet M (and specifically, surfaces 212*a* of the high support members 212 on the +Z side; see FIG. 3A) are positioned higher in the +Z direction than the parts of the low support members 213 that support the sheet M (and specifically, surfaces 213*a* of the low support members 213; see FIG. 3A). In other words, a distance LZ1 between the surfaces 212*a* of the high support members 212 supporting the sheet M and a plane passing through the nozzle-forming surface 241 of the print head 240 is shorter than a distance LZ2 between the surfaces 213*a* of the low support members 213 supporting the sheet M and a plane passing through the nozzle-forming surface 241 of the print head 240.

Further, the surfaces 212*a* of the high support members 212 are positioned farther in the +Z direction than the portions of the pressing members 216 that support the sheet M (and specifically, bottom edges 216*a* of the pressing members 216 on the −Z side and at the downstream end (+Y side end) of the same; see FIG. 3A). Therefore, the distance LZ1 between the surfaces 212*a* of the high support members 212 and a plane passing through the nozzle-forming surface 241 of the print head 240 is shorter than a distance LZ3 between the bottom edges 216*a* of the pressing members 216 supporting the sheet M and a plane passing through the nozzle-forming surface 241 of the print head 240.

Thus, the sheet M is supported by the high support members 212, the low support members 213, and the pressing members 216 in a corrugated state, with undulations progressing in the X direction (see FIG. 3C). While remaining deformed in this corrugated state, the sheet M is conveyed in the conveying direction (+Y direction). When deformed in this corrugated shape, the sheet M has greater rigidity and is resistant to deformation along the Y direction.

A-2. Overview of Control Process

Figure 4:
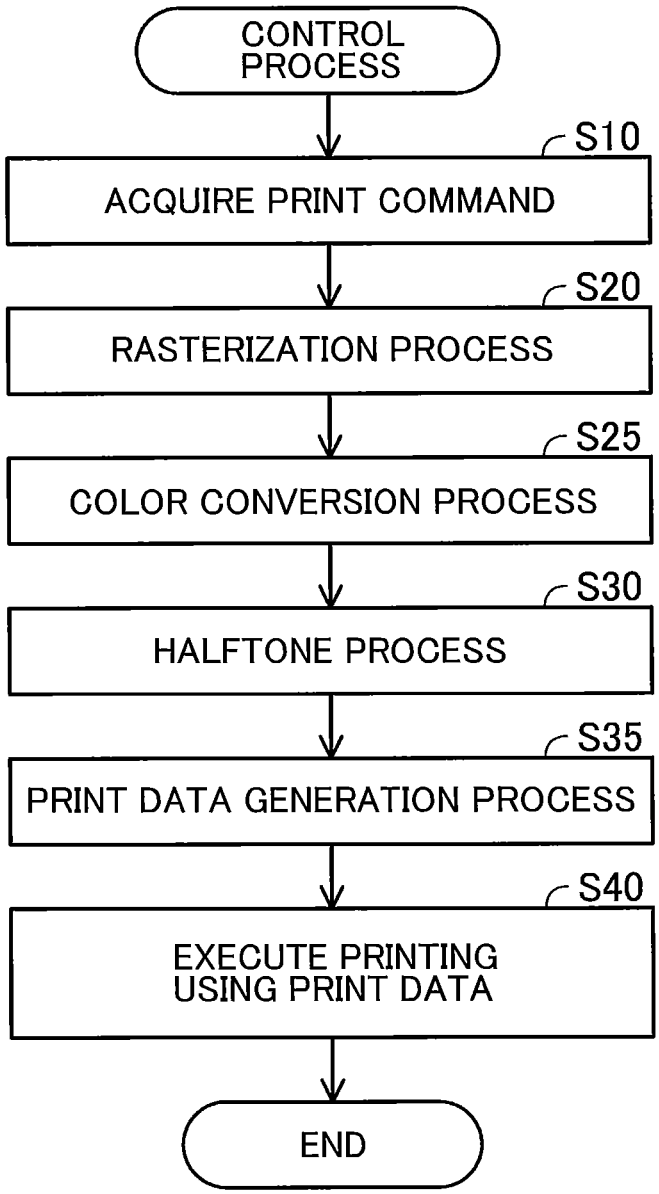
FIG. 4 is a flowchart illustrating steps in a control process according to the embodiments.

Here, the processor 110 of the control unit 100 (see FIG. 1) executes a control process for controlling the printing mechanism 200 to execute a printing process based on a print command from the user. FIG. 4 is a flowchart illustrating steps in this control process.

In S110 of FIG. 4, the processor 110 acquires a print command from the user via the operating unit 150. The print command includes an instruction specifying image data to be printed, an instruction specifying a printing mode, and an instruction specifying the sheet size. The printing mode is selected from "borderless printing" and "normal printing" modes.

In S20 the processor 110 acquires the image data specified by the user from a storage device, such as the nonvolatile storage device 130, and executes a rasterization process on the image data to generate bitmap data representing a target image having a plurality of pixels. The bitmap data is RGB image data representing the color of each pixel in RGB values. Each of the three component values included in the RGB values, i.e., each of the R value, G value, and B value, is a gradation value expressed in one of 256 gradations, for example.

In S25 the processor 110 executes a color conversion process on the RGB image data to generate CMYK image data. The CMYK image data represents the color of each pixel as gradation values for the four color components C, M, Y, and K (hereinafter called the CMYK values). The color conversion process is performed using a lookup table that defines correlations between RGB values and CMYK values, for example.

In S30 the processor 110 executes a halftone process, such as an error diffusion method or a dither method, on the CMYK image data to generate dot data representing the dot formation state of each pixel and for each ink color. Each pixel value in the dot data is one of two values indicating one of two types of dot formation states. Specifically, a pixel value of "1" denotes "dot," while a pixel value of "0" denotes "no dot." Alternatively, each pixel value in the dot data may take on one of four values specifying four types of dot formation states, including "large dot," "medium dot," "small dot," and "no dot." Hereinafter, values representing dot formation states will be called "dot values."

In S35 the processor 110 generates print data based on the printing mode specified in S10, and the dot data generated in S30. The print data includes feed data FD, and m sets of pass data, where m indicates the number of pass processes. Here, m sets of pass data are generated for each type of ink. One set of pass data corresponds to one pass process and is correlated with one set of raster line data for each of the nozzles NZ. One set of raster line data specifies the dot formation state of each pixel in one raster line that includes a plurality of pixels aligned in the main scanning direction and corresponding to one nozzle. The feed data FD includes m values specifying the feed amounts in m sheet-conveying processes performed prior to the respective m passes. This print data is generated based on the control data PCD (see FIG. 1). The control data PCD will be described later in greater detail.

In S40 the processor 110 controls the printing mechanism 200 to execute a printing operation based on the print data generated in S35. Through this process, the processor 110 prints an image on a sheet of paper.

In the first embodiment, the control unit 100 that includes the processor 110 is an example of a controller or a processor, and the printing mechanism 200 is an example of a print execution unit. Alternatively, a personal computer or other terminal device connected to the printer 600 may generate print data by executing the process in S10-S35 described above and may control the printer 600 to execute a printing operation by supplying this print data to the printer 600. In this case, the terminal device is an example of a print control apparatus or processor, and the printer 600 is an example of the print execution unit.

A-3. Overview of Control Data PCD

Figure 5:
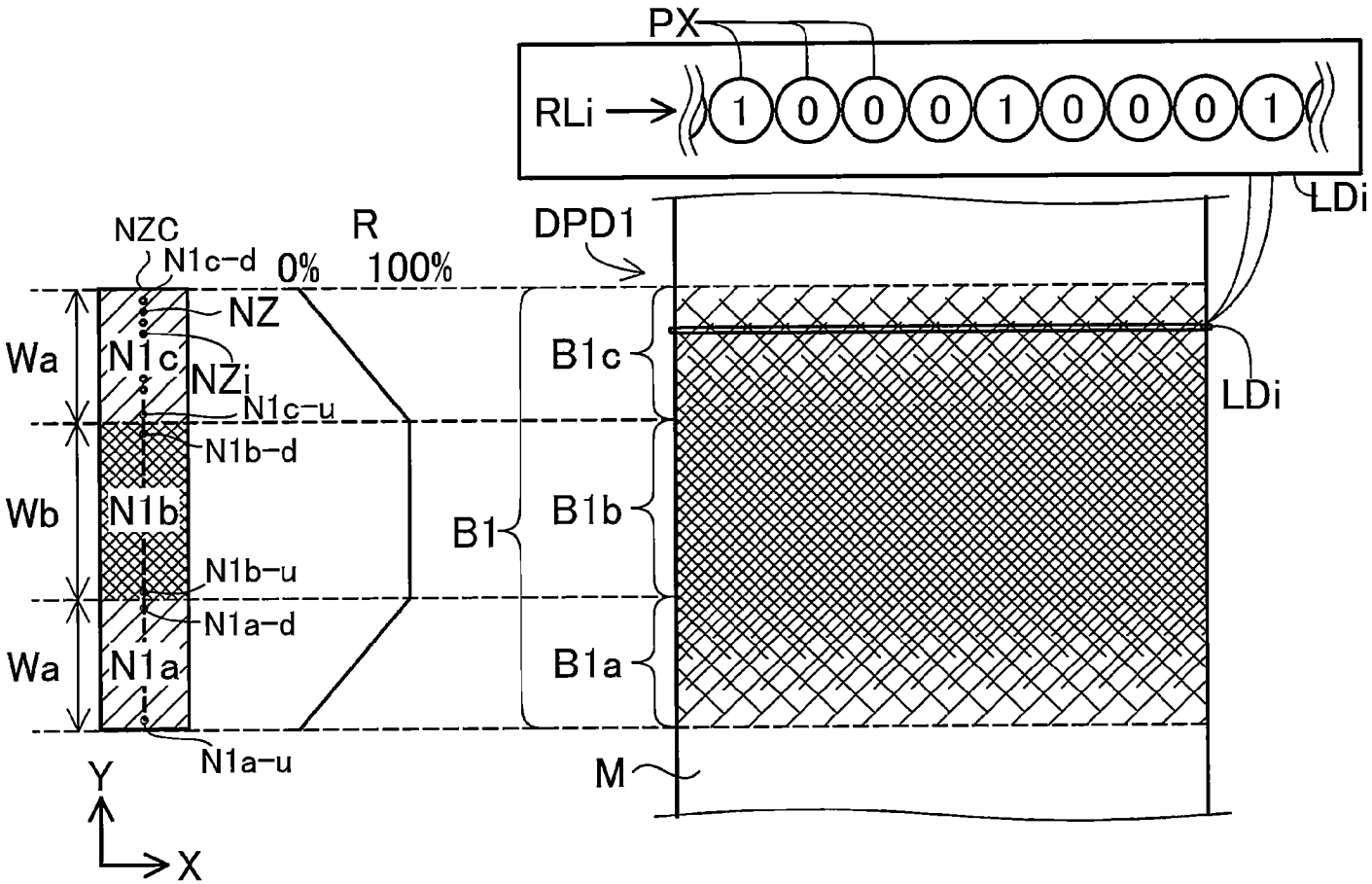
FIG. 5 is an explanatory diagram illustrating dot pattern data used in the control process.

FIG. 5 is an explanatory diagram illustrating dot pattern data DPD included in the control data PCD. FIG. 5 conceptually illustrates a portion DPD1 of the dot pattern data DPD for one specific pass process (hereinafter called "partial dot pattern data DPD1"). The partial dot pattern data DPD1 constitutes the data for a plurality of nozzles NZ in the nozzle row for one color component (the nozzle row NZC, for example). The partial dot pattern data DPD1 correlates dot pattern data for one line with each of the nozzles NZ. Dot pattern data for one line specifies whether to allow dot formation for each pixel in a single raster line that includes a plurality of pixels aligned in the main scanning direction and corresponding one-on-one to individual nozzles. FIG. 5 shows an enlarged view of one part of the $i^{th}$ line dot pattern data LDi. The $i^{th}$ line dot pattern data LDi records either a "1" or a "0" for each of the plurality of pixels PX in a raster line RLi corresponding to the $i^{th}$ nozzle NZ (NZi), where the value "1" indicates that dot formation is allowed and value "0" denotes that dot formation is not allowed. In other words, line dot pattern data defines the positions on the sheet M in the main scanning direction at which dot formation is allowed and at which dot formation is not allowed for corresponding nozzles NZ. The band-like area in FIG. 5 indicates a region on the sheet M in which dots can be formed in one pass process (hereinafter called a "band area B1"). Thus, the partial dot pattern data DPD1 defines pixel positions in the band area B1 at which dot formation is allowed. Images formed on the band areas serve as example of partial images.

The dot pattern data DPD specifies dot pattern data for each of the plurality of pass processes. The feed data FD specifies the feed amount for each of the plurality of conveying processes performed prior to the plurality of respective pass processes. The control data PCD specifies the print control configuration (i.e., the dot pattern data for each of the plurality of pass processes, and the feed amount for each of the plurality of conveying processes) for each of a plurality of combinations of supported sheet sizes and supported printing modes. In S35 of FIG. 4, the processor 110 generates pass data by referencing the portion of the control data PCD that is correlated with the target combination of sheet size and printing mode. In the first embodiment, the same dot pattern data DPD is used for all of the plurality of color components (i.e., for each of the types of ink), but different dot pattern data DPD may be provided for each color component.

One set of pass data indicates a dot value for each pixel position. The dot value for a pixel position at which dot formation is allowed is the same as the dot value set in S30 for the same pixel position on the sheet M. The dot value for a pixel position at which dot formation is prohibited is the same as the dot value indicating "no dot."

The graph of the recording rate R in the left section of FIG. 5 shows the relationships between nozzle positions within the nozzle row in the conveying direction, and the recording rate R for nozzles NZ at corresponding nozzle positions. The recording rate R of a nozzle NZ specifies the ratio of the number of pixels for which dot formation is allowed to the total number of pixels in the raster line corresponding to the nozzle NZ. Thus, the recording rate R of a nozzle NZ is expressed by NM1/(NM1+NM0), where NM1 denotes the number of "1" in line dot pattern data corresponding to the nozzle NZ, while NM0 denotes the number of "0". The "1" values are distributed in each set of line dot pattern data and total a number conforming to the recording rate predefined for the corresponding nozzle NZ. The partial dot pattern data DPD1 on the right side of FIG. 5 is depicted in hatching marks, with denser hatching indicating a higher recording rate R.

The nozzle row NZC in the example of FIG. 5 is divided into three segments N1*a*, N1*b*, and N1*c* that are juxtaposed in the Y direction (the conveying direction). The second segment N1*b* in the center region of the nozzle row NZC has a recording rate R of 100% irrespective of the nozzle position. Specifically, the dot recording rate R of each nozzle between the most-upstream nozzle N1*b-u* and the most-downstream nozzle N1*b-d* of the second segment N1*b* is 100%. The first segment N1*a* on the upstream side (−Y side) of the second segment N1*b* has a recording rate R that decreases linearly from 100% to 0% in the −Y direction as the nozzle position changes in the conveying direction. Specifically, the dot recording rates R of nozzles in the first segment N1*a* decreases from the most-downstream nozzle N1*a-d* of the first segment N1*a* toward the most-upstream nozzle of the nozzles in the nozzle row NZC (that is, the most-upstream nozzle N1*a-u* of the first segment N1*a*). The third segment N1*c* on the downstream side (+Y side) of the second segment N1*b* has a recording rate R that decreases linearly from 100% to 0% in the +Y direction in response to changes in nozzle position in the conveying direction. Specifically, the dot recording rates R of nozzles in the third segment N1*c* decreases from the most-upstream nozzle N1*c-u* of the third segment N1*c* toward the most-downstream nozzle of the nozzles in the nozzle row NZC (that is, the most-downstream nozzle N1*c-d* of the third segment N1*c*). Thus, the recording rate R employed in the first embodiment is a non-uniform recording rate that changes based on the nozzle position in the conveying direction.

As shown in FIG. 5, the length of the second segment N1*b* in the conveying direction is called a width Wb. The length of the first segment N1*a* and third segment N1*c* in the conveying direction are the same width Wa. Hereinafter, lengths in the conveying direction will simply be called "widths." As described above with reference to FIG. 2, the pitch of nozzles NZ in the conveying direction within a single nozzle row is uniform. Accordingly, the width of a specific segment of the nozzle row corresponds to the number of nozzles in the specific segment. For example, if the width of a first segment is equivalent to the width of a second segment, the number of nozzles in the first segment is equal to the number of nozzles in the second segment.

In the following description, the range of nozzle positions in the conveying direction (Y direction) for whose recording rate R is 100%, as in the second segment N1*b*, from among the plurality of nozzles NZ in the print head 240 used in printing will be called the "full-recording range." The portion of the nozzle row within this full-recording range will be called the "full-recording segment." Further, the range of nozzle positions at which the recording rate R decreases from 100% to 0% in the −Y direction (upstream), such as the first segment N1*a* in this example, will be called the "upstream graded range." The portion of the nozzle row that falls within this upstream graded range will be called the "upstream graded segment." Similarly, the range of nozzle positions at which the recording rate R decreases from 100% to 0% in the +Y direction (downstream), such as the third segment N1*c* in this example, will be called the "downstream graded range." The portion of the nozzle row that falls within this downstream graded range will be called the "downstream graded segment."

The band area B1 shown in FIG. 5 is also divided into three regions, including a second partial area B1*b* in which dots are formed by the full-recording segment N1*b*, a first partial area B1*a* in which dots are formed by the upstream graded segment N1*a*, and a third partial area B1*c* in which dots are formed by the downstream graded segment N1*c*. Printing of the second partial area B1*b* is completed in a single pass process. In the same pass process, the upstream graded segment N1*a* forms dots in the first partial area B1*a*, but printing of the first partial area B1*a* is not completed in this pass process. In the first embodiment, printing of the first partial area B1*a* is completed after the upstream graded segment N1*a* forms dots in the first partial area B1*a* and the downstream graded segment N1*c* forms dots in the first partial area B1*a* in the next pass process.

Figure 6:
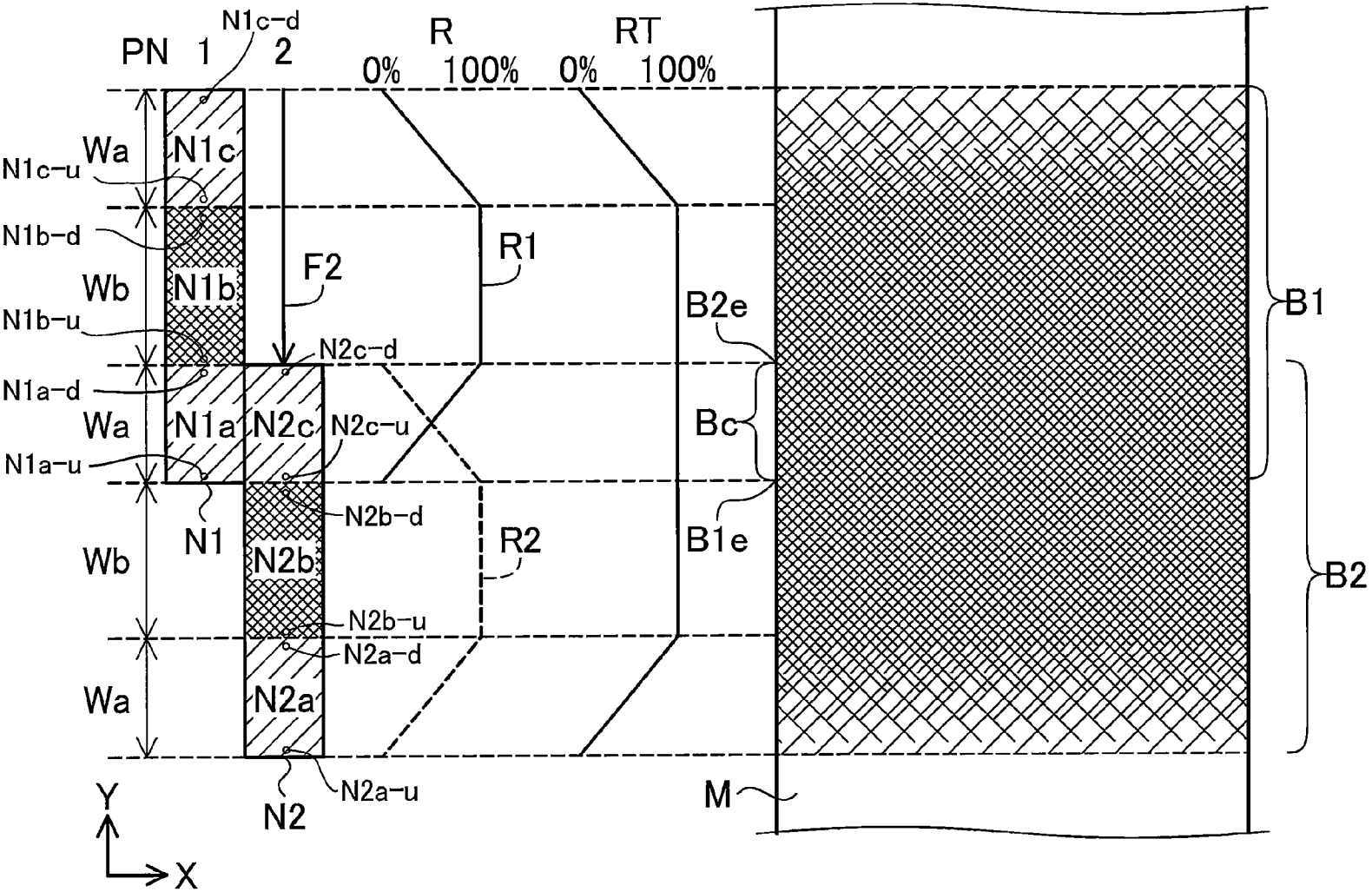
FIG. 6 is an explanatory diagram of printing in two consecutive pass processes according to a first embodiment.

FIG. 6 is a conceptual diagram of printing in two consecutive pass processes. Numbers PN in FIG. 6 denote the pass numbers. The notation Nj assigned to nozzle rows indicates the position of the nozzle row in the conveying direction for the $j^{th}$ pass process (where j is an integer). For example, the first nozzle row N1 indicates the position of the nozzle row in the conveying direction for the first pass process, while the second nozzle row N2 indicates the position of the nozzle row in the conveying direction for the second pass process. Further, the notation Bj assigned to band areas indicates the region on the sheet M in which dots can be formed in the $j^{th}$ pass process. For example, a first band area B1 denotes the region in which dots can be formed by the first nozzle row N1, while a second band area B2 denotes the region in which dots can be formed by the second nozzle row N2. As shown in FIG. 6, the upstream (−Y side) edge of the first band area B1 overlaps the downstream (+Y side) edge of the second band area B2. For the convenience of description, j=1 has been assigned to the initial pass process in the plurality of processes shown in FIG. 6, even though this pass process may not be the first pass process executed in the printing process (this also holds true for other drawings described later).

In the example of FIG. 6, a recording rate R1 and dot pattern data for the first nozzle row N1 and a recording rate R2 and dot pattern data for the second nozzle row N2 are identical to the recording rate R and the partial dot pattern data DPD1 for the nozzle row NZC shown in FIG. 5. Further, the three segments N2*a*, N2*b*, and N2*c* of the second nozzle row N2 are equivalent to the three segments N1*a*, N1*b*, and N1*c* of the first nozzle row N1. Further, nozzles N2*a-u*, N2*a-d*, N2*b-u*, N2*b-d*, N2*c-u*, and N2*c-d* of the second nozzle row N2 are equivalent to the nozzles N1*a-u*, N1*a-d*, N1*b-u*, N1*b-d*, N1*c-u*, and N1*c-d* of the first nozzle row N1. Further, the downstream graded segment N2*c* of the second nozzle row N2 is equal to the width of the upstream graded segment N1*a* in the first nozzle row N1 of the preceding pass process. A feed amount F2 for the conveying process performed between the first pass process and second pass process is set so that the downstream graded segment N2*c* of the second nozzle row N2 is arranged at the same position in the conveying direction as the upstream graded segment N1*a* of the first nozzle row N1. Therefore, the downstream graded segment N2*c* of the second nozzle row N2 and the upstream graded segment N1*a* of the first nozzle row N1 can form dots in the same partial area Bc.

The partial dot pattern data DPD1 (see FIG. 5) is configured such that the plurality of nozzles in the upstream graded segment N1*a* of the first nozzle row N1 and the plurality of nozzles in the downstream graded segment N2*c* of the second nozzle row N2 form dots at different pixel positions from each other in the partial area Bc. That is, the plurality of pixel positions at which the nozzles in the downstream graded segment N2*c* of the second nozzle row N2 are allowed to form dots is equivalent to the plurality of pixel positions at which the nozzles in the upstream graded segment N1*a* of the first nozzle row N1 are prohibited from forming dots. As a result, dots can be formed at all pixel positions in the partial area Bc by forming dots with the upstream graded segment N1*a* in the first pass process and forming dots with the downstream graded segment N2*c* in the second pass process.

FIG. 6 shows a total recording rate RT that denotes the final recording rate R obtained through the plurality of pass processes. In the example of FIG. 6, nozzles in the upstream graded segment N1*a* of the first nozzle row N1 and nozzles in the downstream graded segment N2*c* of the second nozzle row N2 can form dots at differing pixel positions in the partial area Bc. Consequently, the total recording rate RT for the partial area Bc is the sum of the recording rate R1 for the first nozzle row N1 and the recording rate R2 for the second nozzle row N2.

Here, the ratio of changes in the recording rate R to changes in position in the conveying direction (+Y direction) will be called the "recording rate gradient." In the example of FIG. 6, the recording rate gradient for the upstream graded segment N1*a* of the first nozzle row N1 is equivalent to the recording rate gradient for the downstream graded segment N2*c* of the second nozzle row N2 after reversing the sign. Therefore, the total recording rate RT is 100% across the entire partial area Bc overlapped by the first band area B1 and second band area B2.

In this way, the pass processes and conveying processes are repeatedly executed in order that the plurality of nozzles in the upstream graded range (the upstream graded segment N1*a*, for example) and the plurality of nozzles in the downstream graded range of the subsequent pass process (the downstream graded segment N2*c*, for example) print the same partial areas on the sheet M, while the plurality of nozzles in the full-recording range print corresponding partial areas on the sheet M in single pass processes. Through this process, it is possible to partially overlap two neighboring band areas while achieving a total recording rate RT of 100% across the entire printing area of the sheet M. The process of printing a partial area on the sheet M using a plurality of pass processes will be called partial multi-pass printing.

The recording rate R1 at the upstream (−Y side) edge B1*e* of the first band area B1 is lower than the recording rate R1 in other parts of the first band area B1. For example, the recording rate R1 in the upstream edge B1*e* of the first band area B1 is less than 50% (nearly 0% in the example of FIG. 6). This technique can mitigate white lines or uneven printing densities (called "banding") in the area of the second band area B2 overlapped by the upstream edge B1*e* of the first band area B1, even when there is positional deviation in the dot forming positions between the first pass process and second pass process. Further, the recording rate R changes linearly in response to changes in position in the conveying direction in the upstream graded range (the upstream graded segment N1*a*, for example) and the downstream graded range (the downstream graded segment N2*c*, for example). This arrangement can better suppress noticeable irregularities in printing density than when the recording rate R is changed in steps.

As will be described later, the number of nozzles used for printing a single pass process in the first embodiment is varied for the plurality of pass processes in one printing process. However, the pluralities of pass processes and conveying processes are controlled such that the upstream graded segment of a $j^{th}$ pass process and the downstream graded segment of a $j+1^{th}$ pass process can complementarily complete the printing of a common partial area on the sheet M. In this way, edges of two neighboring band areas can be overlapped to achieve a total recording rate RT of 100%.

A-4. Borderless Printing

A-4-1. Overview of Borderless Printing

Figure 7A:
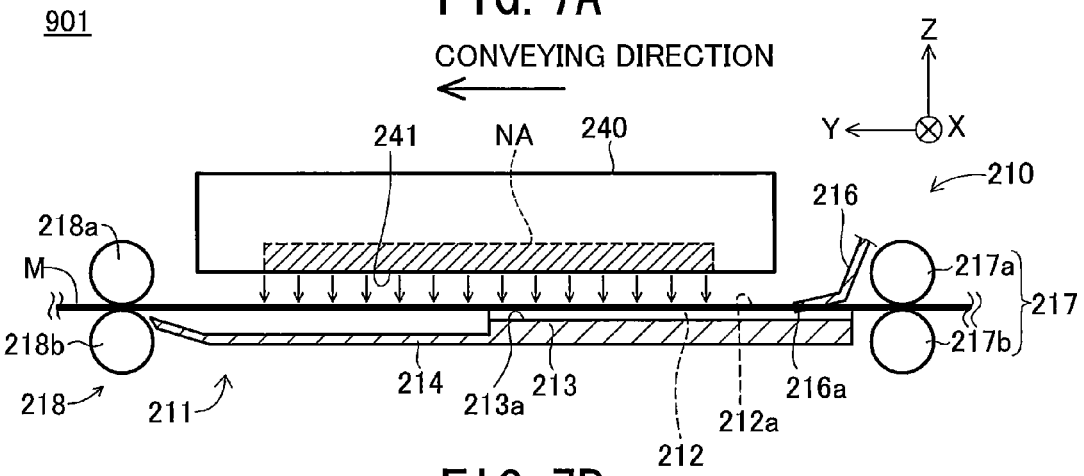
FIG. 7A is an explanatory diagram showing a state of operations when printing an area of a sheet away from its edge portion.
Figure 7B:
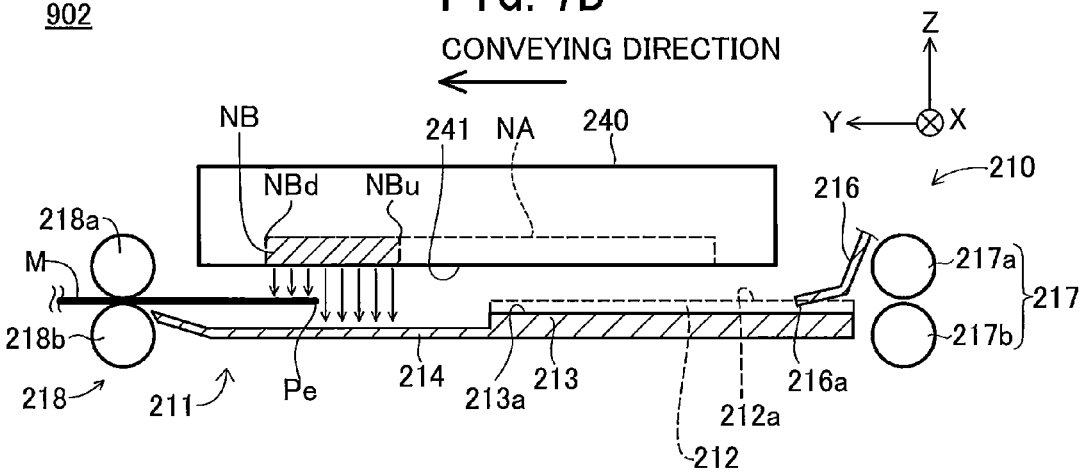
FIG. 7B is an explanatory diagram showing a state of operations when printing an area of the sheet near the edge portion.

FIGS. 7A and 7B are explanatory diagrams illustrating borderless printing. As in FIG. 3A, each of FIGS. 7A and 7B is a schematic diagram with a view from the side of the conveying mechanism 210. FIG. 7A shows the state of operations when printing an area on the sheet M away from its edge portions. FIG. 7B shows the state of operations when printing an area on the sheet M near an upstream edge Pe. In the state shown in FIG. 7A in the first embodiment, the sheet M is held by both the holding unit on the upstream side of the print head 240 (at least one of the pressing members 216 and upstream rollers 217 in this example) and the holding unit on the downstream side of the print head 240 (the downstream rollers 218 in this example). Hereinafter, the state shown in FIG. 7A will be called a first conveying state 901. Pass processes performed while operating under the first conveying state 901 will be called type 1 pass processes. A printing process that includes type 1 pass processes and conveying processes performed under the first conveying state 901 will be called a "first printing process." The first printing process serves as an example of (a)-print process. In the state shown in FIG. 7B, the sheet M is held only by the downstream-side holding unit (the downstream rollers 218). Hereinafter, the state shown in FIG. 7B will be called a second conveying state 902. Pass processes performed while operating under the second conveying state 902 will be called type 2 pass processes, and a printing process that includes the type 2 pass processes and conveying processes performed under the second conveying state 902 will be called a "second printing process." The second printing process serves as an example of (b)-print process. Unlike under the first conveying state 901, the sheet M is not held on the upstream side of the print head 240 under the second conveying state 902. Hence, conveying precision is lower under the second conveying state 902 than under the first conveying state 901.

Under the first conveying state 901 shown in FIG. 7A, all nozzles within the nozzle area NA (i.e., all nozzles in the print head 240) are used in printing. Under the second conveying state 902 shown in FIG. 7B, only nozzles in a partial region NB of the nozzle area NA that includes the downstream end (hereinafter called the "downstream partial region NB") are used in printing. The downstream partial region NB is the portion of the nozzle area NA positioned on the downstream side (+Y side) of the support members 212 and 213 constituting the sheet support 211. The downstream partial region NB does not oppose the support members 212 and 213 that serve to support the sheets, but rather opposes the flat plate 214 that is configured to receive ink and not to support sheets. The upstream edge Pe of the sheet M is positioned between the upstream edge NBu and the downstream edge NBd of the downstream partial region NB. Ink droplets ejected from nozzles in the downstream partial region NB at positions inside of the upstream edge Pe of the sheet M (the downstream side, or +Y side, in this case) form dots on the sheet M, while ink droplets ejected from nozzles in the downstream partial region NB at positions outside of the upstream edge Pe of the sheet M (the upstream side, or −Y side, in this case) is deposited on the flat plate 214 and not the sheet M. Through this process, it is possible to print an image from the middle section of the sheet M all the way to the upstream edge Pe of the sheet M without leaving a margin along the upstream edge Pe.

While not illustrated in the drawings, the downstream edge of the sheet M is printed using the plurality of nozzles in the downstream partial region NB while the downstream edge is positioned between the upstream edge NBu and downstream edge NBd of the downstream partial region NB. In this case, the sheet M is held by the pressing members 216 and upstream rollers 217 positioned upstream of the print head 240 and is not held by the downstream rollers 218 positioned downstream of the print head 240.

A-4-2. First Control Example

Figure 8:
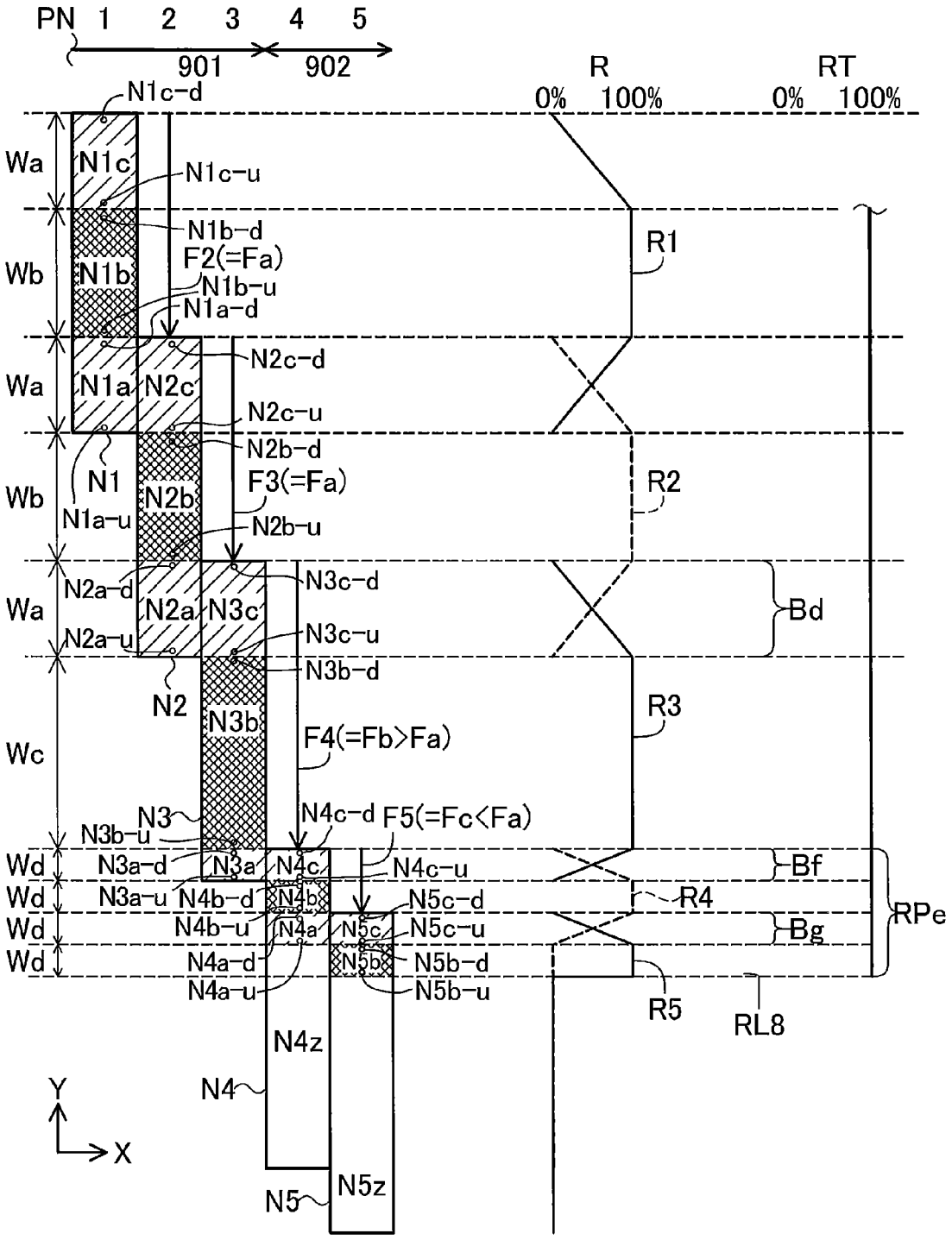
FIG. 8 shows an example of a printing process including a plurality of pass processes according to the first embodiment.

FIG. 8 shows an example of a plurality of pass processes according to the first embodiment. The pass processes in FIG. 8 illustrate the transition from the first printing process under the first conveying state 901 of FIG. 7A to the second printing process under the second conveying state 902 of FIG. 7B. Numbers PN from 1 to 5 at the top of FIG. 8 indicate a series of five pass processes. The notation Nj attached to each nozzle row denotes the position of the nozzle row in the conveying direction (Y direction) for the $j^{th}$ pass process. Arrows with the notation Fj denote the feed amount for conveying processes performed prior to the $j^{th}$ pass process. The graph with notation Rj shows the relationships between nozzle positions in the conveying direction for the nozzle row Nj in the $j^{th}$ pass process and the recording rate R. The graph under the total recording rate RT shows the relationships between positions in the conveying direction and the total recording rate R achieved from all pass processes.

The nozzle row Nj for the $j^{th}$ pass process is divided into a plurality of segments based on the recording rate R. The notation for each segment of the nozzle row Nj is constructed by adding a character (one of "a", "b", "c", or "z") identifying the characteristics of the recording rate R to the end of the notation for the nozzle row (Nj). The upstream graded segment Nja corresponds to the upstream graded range. The full-recording segment Njb corresponds to the full-recording range. The downstream recording segment Njc corresponds to the downstream graded range. The non-recording segment Njz corresponds to the range in which the recording rate R is 0%. In FIG. 8, hatching marks are provided in the portions of the nozzle rows Nj in which the recording rate R is greater than 0% (i.e., segments Nja, Njb, and Njc). Hereinafter, segments in the nozzle rows Nj whose recording rate R is greater than 0 will be called "recording segments." Further, the range of the recording segments for a pass process in the first printing process will be called a "first distribution range," while the range of recording segments for a pass process in the second printing process will be called a "second distribution range." As will be described later, the first and second distribution ranges may differ for each pass process. In other words, nozzles consecutively arranged being selected from the plurality of nozzles NZ in the nozzle row as active nozzles to be used for each pass process. Further, the notation for the most-upstream nozzle of each segments Nja, Njb, and Njc is constructed by adding a character "-u" to the end of the notation for the segment (Nja-u, Njb-u, and Njc-u). Similarly, the notation for the most-downstream nozzle of each segments Nja, Njb, and Njc is constructed by adding a character "-d" to the end of the notation for the segment (Nj a-d, Njb-d, and Njc-d).

In the example of FIG. 8, the three first through third pass processes are type 1 pass processes performed under the first conveying state 901, while the two fourth and fifth pass processes are type 2 pass processes performed under the second conveying state 902. The first and second pass processes in FIG. 8 are identical to the first and second pass processes shown in FIG. 6. While not shown in FIG. 8, pass processes identical to the first pass process and conveying processes at the feed amount F2 are normally repeated a plurality of times prior to the first pass process in FIG. 8. These normal pass processes print the middle section of the sheet M between the upstream end and the upstream end. The feed amount normally repeated in the first printing process while operating in the first conveying state 901 will be called the feed amount Fa. The feed amount Fa is the most frequently used feed amount in the plurality of conveying processes performed in the first printing process. In the following description of the first printing process for printing one sheet M, when a plurality of values are used as the value of a single parameter (the feed amount or width of the recording segment, for example), the most frequently used value will be employed as the value normally repeated in the first printing process.

A recording rate R3 for a third nozzle row N3 differs from the recording rate R2 for the second nozzle row N2 as follows. The full-recording segment N3*b* of the third nozzle row N3 is expanded toward the upstream side (in the −Y direction) more than the full-recording segment N2*b* of the second nozzle row N2 (width We of full-recording segment N3*b*>width Wb of full-recording segment N2*b*). Further, the upstream graded segment N3*a* of the third nozzle row N3 is contracted toward the upstream side (in the −Y direction) more than the upstream graded segment N2*a* of the second nozzle row N2 (width Wd of upstream graded segment N3*a*<width Wa of upstream graded segment N2*a*). The width Wa of the downstream graded segment N3*c* of the third nozzle row N3 is equivalent to the width Wa of the upstream graded segment N2*a* in the second nozzle row N2. The feed amount F3 for the conveying process performed prior to the third pass process is equivalent to the feed amount F2 for the conveying process performed prior to the second pass process. In other words, the feed amount F3 is the sum of the width Wb of the full-recording segment N2*b* in the second nozzle row N2 and the width Wa of the downstream graded segment N2*c*. Hence, nozzles in both the downstream graded segment N3*c* of the third nozzle row N3 and the upstream graded segment N2*a* of the second nozzle row N2 can form dots in the same partial area Bd on the sheet M. Accordingly, the total recording rate RT is 100% across this entire partial area Bd.

Next, a recording rate R4 of a fourth nozzle row N4 will be described. The fourth nozzle row N4 is divided into the four segments N4*z*, N4*a*, N4*b*, and N4*c* based on the recording rate R4. The segment N4*z* includes the upstream end of the fourth nozzle row N4 and is a non-recording segment (R4=0). The remaining three segments N4*a*, N4*b*, and N4*c* are juxtaposed in this order toward the downstream side (+Y direction). The widths of these three segments N4*a*, N4*b*, and N4*c* are all equivalent to the width Wd of the upstream graded segment N3*a* in the third nozzle row N3 of the preceding pass process. A feed amount F4 used in the conveying process performed prior to the fourth pass process is the sum of the width We of the full-recording segment N3*b* in the third nozzle row N3 and the width Wa of the downstream graded segment N3*c* (hereinafter called the "feed amount Fb"). Therefore, nozzles in both the downstream graded segment N4*c* of the fourth nozzle row N4 and the upstream graded segment N3*a* of the third nozzle row N3 can form dots in the same partial area Bf on the sheet M. Accordingly, the total recording rate RT is 100% across the entire partial area Bf.

Next, a recording rate R5 for a fifth nozzle row N5 will be described. The fifth nozzle row N5 is divided into the three segments N5*z*, N5*b*, and N5*c* according to the recording rate R5. The segment N5*z* includes the upstream end of the fifth nozzle row N5 and is a non-recording segment (R5=0). The remaining two segments N5*b* and N5*c* are juxtaposed in order toward the downstream side (in the +Y direction). The widths of these two segments N5*b* and N5*c* are both equivalent to the width Wd of the upstream graded segment N4*a* in the fourth nozzle row N4. A feed amount F5 used in the conveying process performed prior to the fifth pass process is the sum of the width Wd of the full-recording segment N4*b* in the fourth nozzle row N4 and the width Wd of the downstream graded segment N4*c* (hereinafter called the "feed amount Fc"). Hence, nozzles in both the downstream graded segment N5*c* of the fifth nozzle row N5 and the upstream graded segment N4*a* of the fourth nozzle row N4 can form dots in the same partial area Bg on the sheet M. Accordingly, the total recording rate RT is 100% across the entire partial area Bg.

Note that the upstream graded segment has been omitted from the fifth nozzle row N5. A raster line RL8 corresponding to the upstream end of the full-recording segment N5*b* in the fifth nozzle row N5 constitutes the upstream edge of the printable area.

In this way, the total recording rate RT is 100% in the partial area printed by an upstream graded segment of one pass process and the downstream graded segment of the succeeding pass process. Similarly, the total recording rate RT is 100% in all partial areas printed by the full-recording segment. Accordingly, a 100% total recording rate RT can be achieved across the entire printable area.

In FIG. 8, an edge printing range RPe denotes the range in the conveying direction in which dots can be printed by pass processes performed under the second conveying state 902. The pluralities of pass processes and conveying processes used for printing this edge printing range RPe are configured such that the upstream edge Pe of the sheet M (see FIG. 7B) is positioned within the edge printing range RPe when the printer 600 prints the region near the upstream edge Pe. This configuration prevents a margin from being left along the upstream edge Pe of the sheet M.

In the control example of FIG. 8, the width Wd of the upstream graded segment N3*a* in the third nozzle row N3 for the final pass process of the first conveying state 901 is smaller than the width Wa of the upstream graded segment normally repeated during the first conveying state 901. Accordingly, printing for the region in which nozzles in the upstream graded segment N3*a* of the third nozzle row N3 form dots during the final pass process performed under the first conveying state 901 can be completed using a pass process under the second conveying state 902 whose recording segments in the nozzle row have a small width.

As described above, conveying precision is worse under the second conveying state 902 than under the first conveying state 901. Hence, when the feed amount for a single conveying process is maintained the same, deviation in dot forming positions can be greater under the second conveying state 902 than under the first conveying state 901. In the control example of FIG. 8, the feed amount F5 used in the second printing process while the sheet is under the second conveying state 902 is smaller than the feed amount Fa used in normal conveying processes repeated under the first conveying state 901. Hence, the control example of FIG. 8 can suppress deviations in dot forming positions in the second printing process.

Further, in the control example of FIG. 8, the width Wd of the upstream graded segment N3*a* in the third nozzle row N3 used for the final pass process under the first conveying state 901 is equivalent to the width Wd of the downstream graded segment N4*c* in the fourth nozzle row N4 used for the initial pass process under the second conveying state 902. Accordingly, the control example of FIG. 8 can complete printing of the partial area Bf through the combined use of the upstream graded segment N3*a* in the third nozzle row N3 and the downstream graded segment N4*c* in the fourth nozzle row N4.

Further, as described with reference to FIGS. 7A and 7B, the width of the recording segments for pass processes under the second conveying state 902 (the width of the downstream partial region NB, for example) is smaller than the maximum width of recording segments for pass processes under the first conveying state 901 (the width of the nozzle area NA, for example). In the example of FIG. 8, the sum of the widths of the recording segments N4*a*, N4*b*, and N4*c* in the fourth nozzle row N4 used under the second conveying state 902 and the sum of the widths of the recording segments N5*b* and N5*c* in the fifth nozzle row N5 used under the second conveying state 902 are smaller than the maximum width (Wa+Wb+Wa) of recording segments under the first conveying state 901. As with the downstream partial region NB in FIG. 7B, the recording segments for each pass process under the second conveying state 902 are positioned downstream of the support members 212 and 213. Hence, the recording segments for each pass process in the second conveying state 902 fall within a range opposing the flat plate 214, which is designed to receive ink rather than support sheets, and that does not oppose the support members 212 and 213 used to support sheets. Accordingly, this arrangement protects the support members 212 and 213 from becoming soiled with ink when printing a region of the sheet M near the upstream edge Pe.

Further, the feed amount F4 (i.e., the feed amount Fb) for the conveying process performed when transitioning from the first printing process to the second printing process is larger than the normal feed amount Fa repeated during the first printing process. Since a large area is printed by the first printing process, which has greater conveying precision than the second printing process, this method can suppress banding, such as white lines and uneven densities, caused by irregularities in sheet-conveying amounts.

Further, the width We of the full-recording segment N3*b* in the third nozzle row N3 used to perform the final pass process in the first conveying state 901 is larger than the width Wb of the full-recording segment for normal pass processes repeated in the first conveying state 901. More specifically, the width of the full-recording segment N3*b* is expanded so that the full width of the upstream graded segment N3*a* and full-recording segment N3*b* is no different from the full width of the upstream graded segment and full-recording segment in normal pass processes repeated under the first conveying state 901 (Wb+Wa). This approach can reduce the width of the upstream graded segment N3*a* without decreasing the width of the area in which nozzles in the third nozzle row N3 form dots.

Through the above process, the printer 600 can suitably overlap edges of two neighboring bands having non-uniform dot recording rates R.

Note that FIG. 8 serves to describe a case in which the printer 600 prints an area of a sheet M near the upstream edge Pe (see FIG. 7B). However, various control methods may be applied when printing the area of a sheet M near the downstream edge (not shown). For example, it is possible to use a plurality of recording segments Nja, Njb, and Njc obtained by vertically inverting the layout pattern of the recording segments Nja, Njb, and Njc in FIG. 8. That is, the plurality of recording segments for printing the downstream end of a sheet M are obtained by inverting the recording segments Nja, Njb, and Njc in FIG. 8 about an axis extending in the main scanning direction so that the recording segments juxtaposed from the middle section of the sheet M toward the upstream edge Pe in FIG. 8 are reordered to be juxtaposed from the middle section of the sheet M toward the downstream edge. Then the configuration of the pluralities of pass processes and conveying processes may be set so that these recording segments can be implemented. This process of printing the region of the sheet M near the downstream edge is similar for the other control examples described below.

A-4-3. Second Control Example

Figure 9:
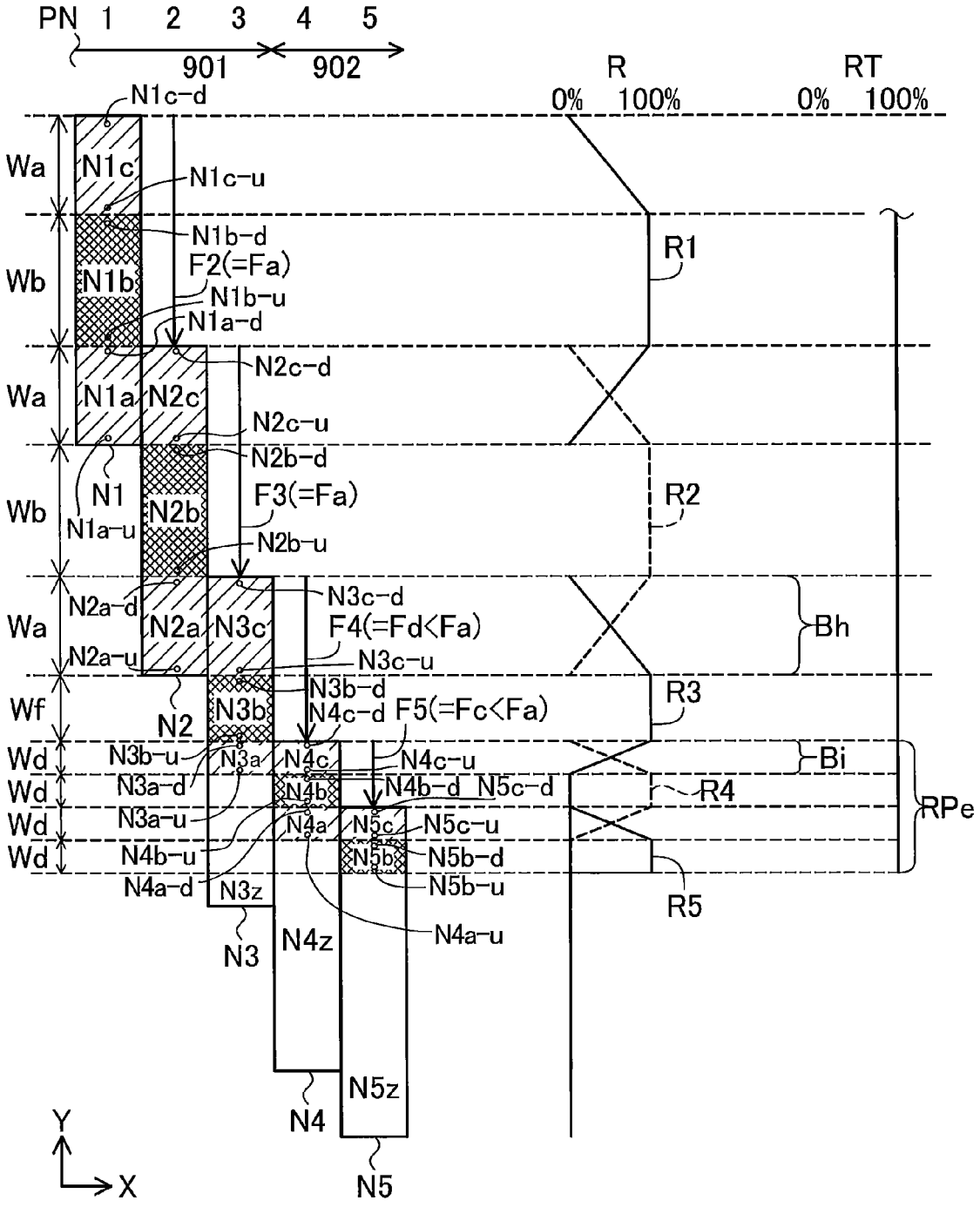
FIG. 9 shows an example of a printing process including a plurality of pass processes according to a second embodiment.

FIG. 9 illustrates another example of pass processes according to a second embodiment. The second control example according to the second embodiment differs from the first control example of FIG. 8 in the recording rate R3 for the third nozzle row N3 of the third pass process, and the feed amount F4 for the conveying process performed after the third pass process. The remaining configuration is identical to the control example of FIG. 8.

Next, the recording rate R3 of the third nozzle row N3 will be described. The third nozzle row N3 is divided into four segments N3*z*, N3*a*, N3*b*, and N3*c* based on the recording rate R3. The segment N3*z* includes the upstream end of the third nozzle row N3 and is a non-recording segment (R3=0). The remaining three segments N3*a*, N3*b*, and N3*c* are juxtaposed in order toward the downstream side (in the +Y direction). The width Wd of the upstream graded segment N3*a* is equivalent to the width Wd of the downstream graded segment N4*c* in the fourth nozzle row N4. A width Wf of the full-recording segment N3*b* is smaller than the width Wb of the full-recording segment N2*b* in the second nozzle row N2. The width Wa of the downstream graded segment N3*c* is equivalent to the width Wa of the upstream graded segment N2*a* in the second nozzle row N2. The feed amount F3 used in the conveying process prior to the third pass process is the sum of the width Wb of the full-recording segment N2*b* and the width Wa of the downstream graded segment N2*c* in the second nozzle row N2. Hence, nozzles in the downstream graded segment N3*c* of the third nozzle row N3 and the upstream graded segment N2*a* of the second nozzle row N2 can form dots in the same partial area Bh on the sheet M. Thus, the total recording rate RT is 100% across the entire partial area Bh.

The feed amount F4 used in the conveying process performed after the third pass process is the sum of the width Wf of the full-recording segment N3*b* and the width Wa of the downstream graded segment N3*c* in the third nozzle row N3 (hereinafter, the width Wf will be called the "feed amount Fd"). Hence, nozzles in the downstream graded segment N4*c* of the fourth nozzle row N4 and in the upstream graded segment N3*a* of the third nozzle row N3 can form dots in the same partial area Bi on the sheet M. Accordingly, the total recording rate RT is 100% across the entire partial area Bi.

As in the control example of FIG. 8, the second control example of FIG. 9 can suitably overlap edges of two neighboring bands having non-uniform dot recording rates R. Further, the edge printing range RPe in FIG. 9 denotes the range in the conveying direction across which dots can be formed in pass processes performed under the second conveying state 902. The pluralities of pass processes and conveying processes for printing in this edge printing range RPe are configured such that the upstream edge Pe (see FIG. 7B) of the sheet M is positioned within the edge printing range RPe when the region of the sheet M near the upstream edge Pe is printed. Accordingly, this configuration avoids leaving a margin near the upstream edge Pe of the sheet M.

Further, some recording segments of the final pass process performed during the first printing process might overlap a partial area in which dots are to be formed only in the second printing process when only normal pass processes with the usual widths of recording segments (Wa+Wb+Wa) and only normal feed amounts Fa are forcibly repeated throughout the first printing process. However, in the control example shown in FIG. 9, the total width of the recording segments in the third nozzle row N3 (N3*a*, N3*b*, and N3*c*) used in the final pass process of the first printing process is shorter than the total width of the normal recording segments (Wa+Wb+Wa) repeated in the first printing process under the first conveying state 901. More particularly, the widths of the upstream graded segment N3*a* and full-recording segment N3*b* in the example of FIG. 9 are shorter than the normal widths. Hence, this control process can prevent the recording segments of the third nozzle row N3 (N3*a*, N3*b*, and N3*c*) for the final pass process in the first printing process from overlapping a partial area to be printed only by pass processes in the second printing process.

A-4-4. Third Control Example

Figure 10:
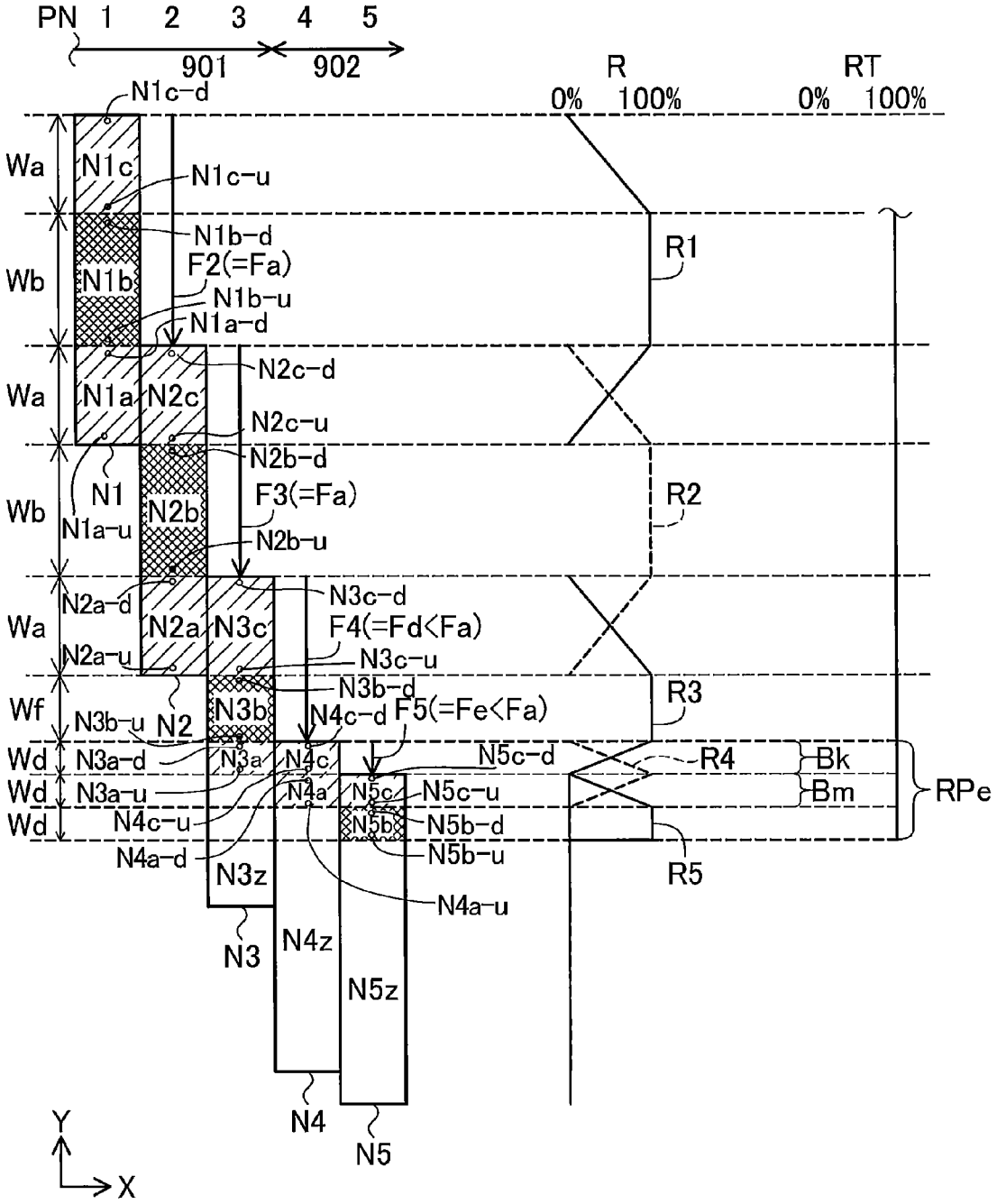
FIG. 10 shows an example of a printing process including a plurality of pass processes according to a third embodiment.

FIG. 10 shows another example of pass processes according to a third embodiment. The third control example according to the third embodiment shown in FIG. 10 differs from the control example according to the second embodiment shown in FIG. 9 only in that the full-recording segment N4*b* of the fourth nozzle row N4 has been omitted. The remaining configuration is identical to that in the second control example of FIG. 9.

Next, the recording rate R4 for the fourth nozzle row N4 will be described. The fourth nozzle row N4 is divided into three segments N4*z*, N4*a*, and N4*c* based on the recording rate R4. The segment N4*z* includes the upstream edge of the fourth nozzle row N4 and is a non-recording segment (R3=0). The remaining two segments N4*a* and N4*c* are juxtaposed in order toward the downstream side (in the +Y direction). The width Wd of the upstream graded segment N4*a* is equivalent to the width Wd of the downstream graded segment N5*c* in the fifth nozzle row N5. The width Wd of the downstream graded segment N4*c* is equivalent to the width Wd of the upstream graded segment N3*a* in the third nozzle row N3. The feed amount F4 used in the conveying process performed prior to the fourth pass process is the sum of the width Wf of the full-recording segment N3*b* in the third nozzle row N3 and the width Wa of the downstream graded segment N3*c*. Therefore, the downstream graded segment N4*c* in the fourth nozzle row N4 and the upstream graded segment N3*a* in the third nozzle row N3 can form dots in the same partial area Bk on the sheet M. Accordingly, the total recording rate RT is 100% across the entire partial area Bk.

Further, the feed amount F5 used in the conveying process performed after the fourth pass process is equivalent to the width Wd of the downstream graded segment N4*c* in the fourth nozzle row N4 (hereinafter, the feed amount F5 will be called the "feed amount Fe"). Hence, the downstream graded segment N5*c* in the fifth nozzle row N5 and the upstream graded segment N4*a* in the fourth nozzle row N4 can form dots in the same partial area Bm on the sheet M. Accordingly, the total recording rate RT is 100% across the entire partial area Bm.

Thus, just as with the control example in FIG. 9, the control example in FIG. 10 can suitably overlap edge portions of two neighboring bands having non-uniform dot recording rates R. Further, the edge printing range RPe in FIG. 10 indicates the range in the conveying direction over which dots can be formed in pass processes during the second conveying state 902. The pluralities of pass processes and conveying processes for printing in the edge printing range RPe are configured so that the upstream edge Pe (see FIG. 7B) of the sheet M is positioned within the edge printing range RPe when the printer 600 is printing the region of the sheet M near the upstream edge Pe. This configuration avoids leaving a margin near the upstream edge Pe of the sheet M.

In the control examples described above with reference to FIGS. 8, 9, and 10, the printing control configuration (the combinations of dot pattern data (that is the recording rate R) for each pass process and the feed amount for each conveying process) is predetermined for each supported sheet size. When executing borderless printing on a sheet M of a specific size, the processor 110 references the control data PCD in S35 of FIG. 4 to identify the control configuration used for borderless printing that has been correlated with the specified sheet size and generates print data according to the identified control configuration.

A-5. Single-Held Printing

A-5-1. Overview of Single-Held Printing

Figure 11A:
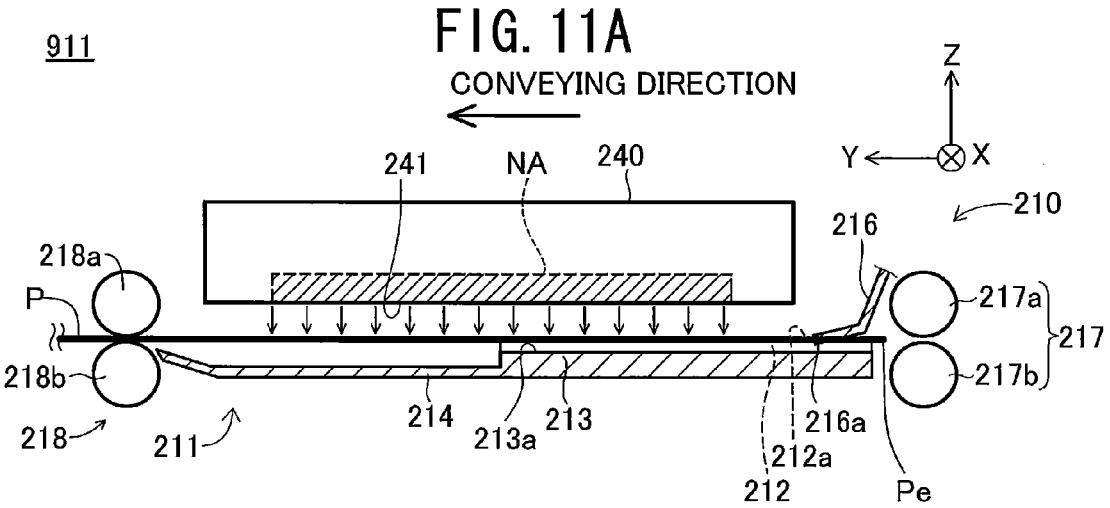
FIG. 11A is an explanatory diagram showing operations under a first conveying state.
Figure 11B:
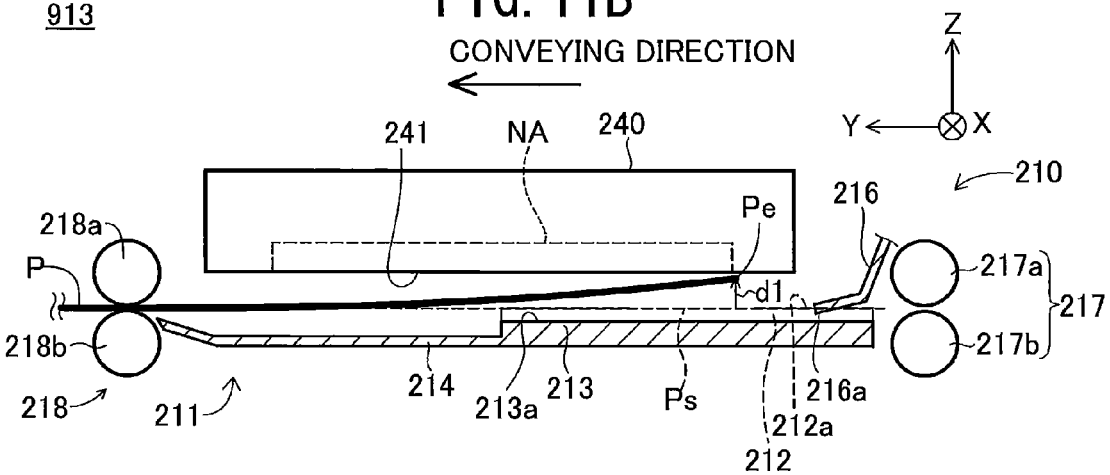
FIG. 11B is an explanatory diagram showing operations when an upstream edge of the sheet is positioned on the upstream side.
Figure 11C:
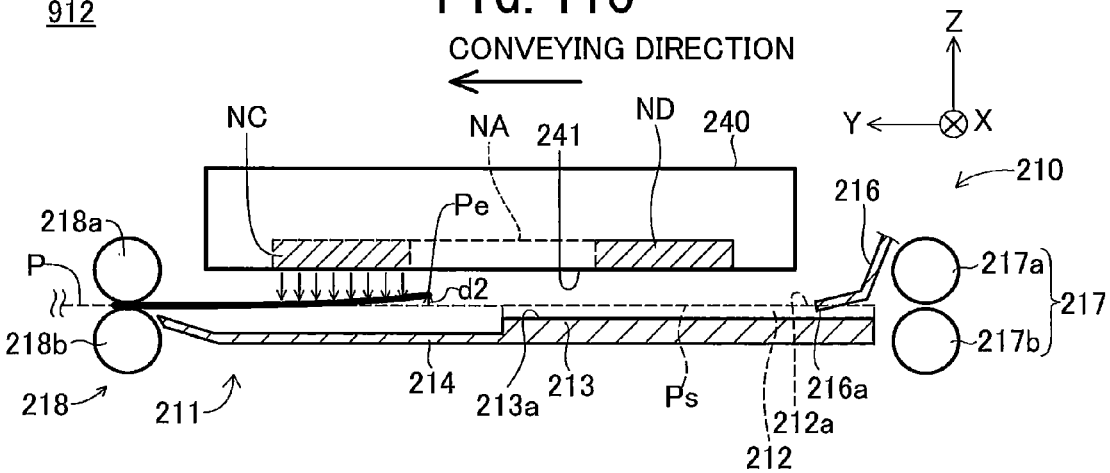
FIG. 11C is an explanatory diagram showing operations under a second conveying state.

Fourth embodiment will be explained. FIGS. 11A-11C are explanatory diagrams for single-held printing. The printer 600 executes single-held printing when normal printing is specified in the print command acquired in S10 of FIG. 4. Each of FIGS. 11A-11C is a schematic diagram with a view from the side of the conveying mechanism 210 similar to that in FIG. 3A. FIG. 11A shows the state of a sheet M held by both the upstream-side holding unit (at least one of the pressing members 216 and upstream rollers 217 in this example) upstream of the print head 240, and the downstream-side holding unit (the downstream rollers 218 in this example) downstream of the print head 240. In the following description, the operating state shown in FIG. 11A will be called the "first conveying state 911." Pass processes performed when operating in the first conveying state 911 will be called type 1 pass processes. A printing process that includes type 1 pass processes and conveying processes performed in the first conveying state 911 will be called a "first printing process." FIGS. 11B and 11C show the state of the sheet M held only by the downstream-side holding unit. In the state 913 shown in FIG. 11B, the upstream edge Pe of the sheet M is positioned upstream of the nozzle area NA. In the state 912 shown in FIG. 11C, the upstream edge Pe of the sheet M is positioned in opposition to the downstream section of the nozzle area NA.

A reference plane Ps shown in FIGS. 11B and 11C indicates the position of the sheet M determined by the surfaces 212*a* of the high support members 212. In the first conveying state 911 (see FIG. 11A), the sheet M is held by holding units positioned on both upstream and downstream sides of the print head 240 (the pressing members 216 and the downstream rollers 218, for example). Hence, the sheet M does not normally move closer to the print head 240 than the reference plane Ps. However, when the sheet M is held only by one of the upstream-side and downstream-side holding units, as shown in FIGS. 11B and 11C (the downstream rollers 218 in this case), a portion of the sheet M may move upward from the reference plane Ps to a position nearer the print head 240. In the examples of FIGS. 11B and 11C, the upstream edge Pe of the sheet M can move to a position near the print head 240. Alternatively, while not illustrated in the drawings, if the sheet M were to be bowed so as to form a convex shape on the +Z side, the apex of the convex portion could approach a position near the print head 240.

When part of the sheet M separates from the reference plane Ps and moves nearer to the print head 240 as described above, the distance between the nozzles NZ and the sheet M becomes unintentionally shorter, causing the dot forming positions on the sheet M to deviate from their intended positions. Such positional deviation is greater when the difference between the reference plane Ps and the sheet M is larger. FIGS. 11B and 11C indicate respective distances d1 and d2 between the upstream edge Pe of the sheet M and the reference plane Ps. Since the upstream edge Pe of the sheet M is farther from the downstream rollers 218 under the state 913 shown in FIG. 11B than under the state 912 shown in FIG. 11C, the distance d1 between the upstream edge Pe of the sheet M and the reference plane Ps is greater than the distance d2. Hence, there is greater deviation in dot forming positions under the state 913 shown in FIG. 11B than under the state 912 shown in FIG. 11C.

Therefore, the printing process according to the fourth embodiment is controlled so as to transition from the first conveying state 911 shown in FIG. 11A to the state 912 shown in FIG. 11C while avoiding printing under the state 913 shown in FIG. 11B. Hereinafter, the state 912 in FIG. 11C will be called the "second conveying state 912." Further, pass processes performed under the second conveying state 912 will be called "type 2 pass processes." A printing process that includes type 2 pass processes and conveying processes performed while under the second conveying state 912 will be called a "second printing process." In the first conveying state 911, all of the nozzles within the nozzle area NA (i.e., all nozzles formed in the print head 240) are used in printing. In the second conveying state 912, the nozzles in the partial region NC (hereinafter called the "downstream partial region NC") that includes the downstream end of the nozzle area NA are used in printing. In single-held printing, ink is ejected from nozzles in the downstream partial region NC while the sheet M is positioned to confront the entire downstream partial region NC. Therefore, ink is prevented from being ejected beyond the upstream edge Pe of the sheet M and landing on the sheet support 211. Since ink is not deposited on the sheet support 211 during single-held printing, the downstream partial region NC may include nozzles NZ that oppose the support members 212 and 213.

Under the second conveying state 912, the sheet M is not held on the upstream side of the print head 240, unlike under the first conveying state 911. Hence, conveying precision is lower under the second conveying state 912 than under the first conveying state 911.

While not illustrated in the drawings, an image is printed on a region of the sheet M near the downstream edge thereof when the sheet M is under a third conveying state. Under the third conveying state, the sheet M is held only by the upstream-side holding unit (at least one of the pressing members 216 and upstream rollers 217 in this example). Nozzles in the downstream partial region NC (see FIG. 11C) are also used for printing under this third conveying state. Alternatively, a plurality of nozzles in a partial region ND (hereinafter called the "upstream partial region ND") of the nozzle area NA that includes the upstream end thereof may be used in printing. Using these upstream-side nozzles can reduce the distance between the downstream edge of the sheet M and the holding unit holding the sheet M (the pressing members 216, for example), thereby suppressing deviation in dot forming positions.

A-5-2. Fourth Control Example

Figure 12:
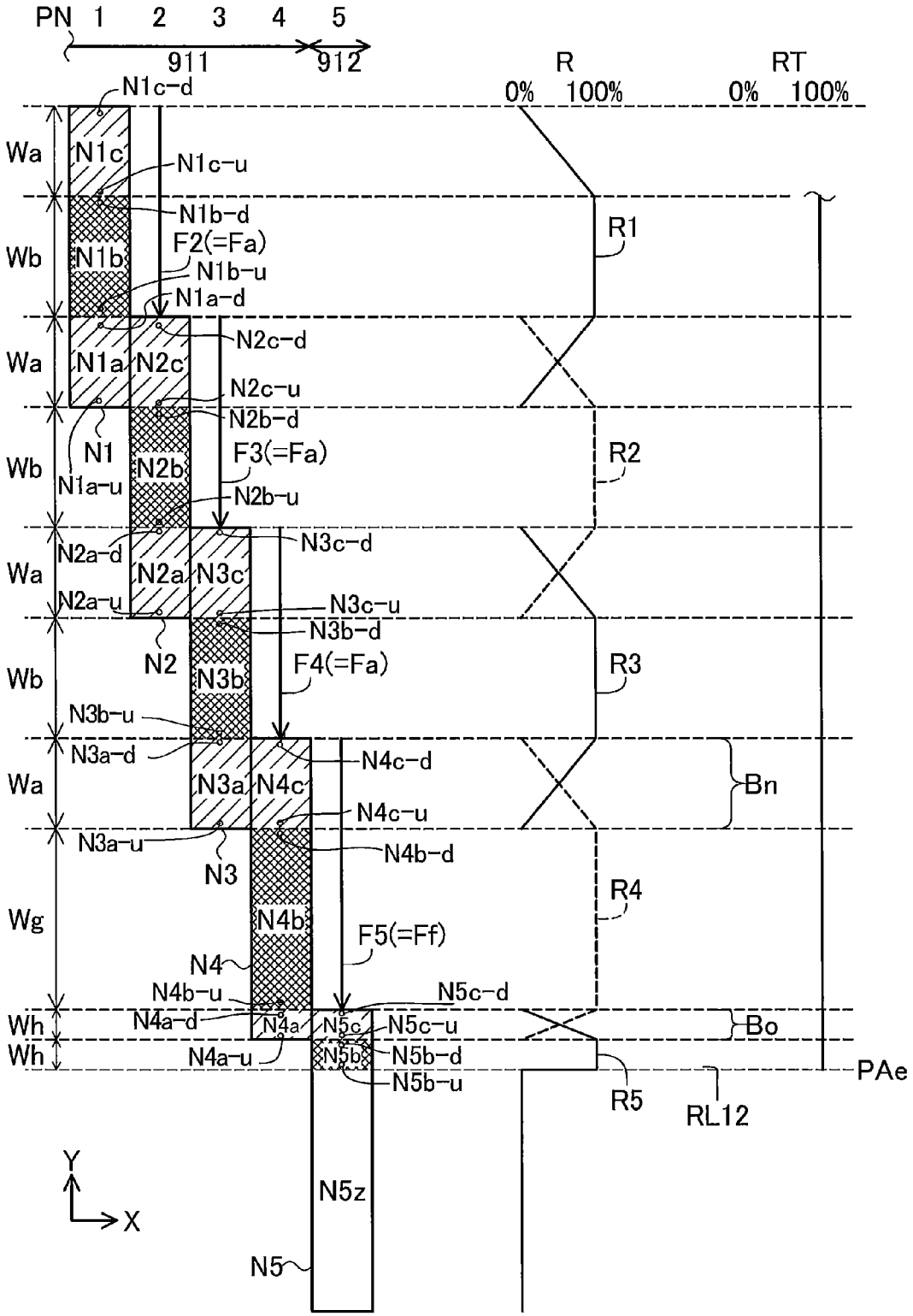
FIG. 12 shows an example of a printing process including a plurality of pass processes according to a fourth embodiment.

FIG. 12 shows an example of pass processes performed in single-held printing in the fourth embodiment. The first through third pass processes in FIG. 12 are identical to the first and second pass processes in the examples of FIGS. 8 and 9, for example. In the fourth control example according to the fourth embodiment, the recording rate R4 for the fourth nozzle row N4 differs from the recording rate R3 for the third nozzle row N3 as follows. The full-recording segment N4*b* of the fourth nozzle row N4 expands toward the upstream side (−Y side) more than the full-recording segment N3*b* of the third nozzle row N3 (width Wg of full-recording segment N4*b*>width Wb of full-recording segment N3*b*). Further, the upstream graded segment N4*a* of the fourth nozzle row N4 is contracted toward the upstream side (−Y side) more than the upstream graded segment N3*a* of the third nozzle row N3 (width Wh of upstream graded segment N4*a*<width Wa of upstream graded segment N3*a*). The width Wa of the downstream graded segment N4*c* in the fourth nozzle row N4 is equivalent to the width Wa of the upstream graded segment N3*a* in the third nozzle row N3. The feed amount F4 used in the conveying process performed prior to the fourth pass process is the sum of the width Wb of the full-recording segment N3*b* in the third nozzle row N3 and the width Wa of the downstream graded segment N3*c*. Hence, the downstream graded segment N4*c* of the fourth nozzle row N4 and the upstream graded segment N3*a* of the third nozzle row N3 can form dots in the same partial area Bn on the sheet M. Accordingly, the total recording rate RT is 100% across the entire partial area Bn.

Next, the recording rate R5 for the fifth nozzle row N5 will be described. The fifth nozzle row N5 is divided into three segments N5*z*, N5*b*, and N5*c* according to the recording rate R5. The segment N5*z* includes the upstream edge of the fifth nozzle row N5 and is a non-recording segment (R5=0). The remaining two segments N5*b* and N5*c* are juxtaposed in order toward the downstream side (in the +Y direction). The widths of these two segments N5*b* and N5*c* are equivalent to the width Wh of the upstream graded segment N4*a* in the fourth nozzle row N4. The feed amount F5 used in the conveying process performed prior to the fifth pass process is the sum of the width Wd of the full-recording segment N4*b* in the fourth nozzle row N4 and the width Wd of the downstream graded segment N4*c* (hereinafter, the feed amount F5 will be called the "feed amount Ff"). Hence, the downstream graded segment N5*c* of the fifth nozzle row N5 and the upstream graded segment N4*a* of the fourth nozzle row N4 can form dots in the same partial area Bo on the sheet M. Accordingly, the total recording rate RT is 100% across the entire partial area Bo.

Note that the upstream graded segment has been omitted from the fifth nozzle row N5. A raster line RL12 corresponding to the upstream end of the full-recording segment N5*b* in the fifth nozzle row N5 constitutes an upstream edge PAe of the printing area on the sheet M.

As in the other control examples described above, the control example shown in FIG. 12 can suitably overlap edges of two neighboring bands having non-uniform dot recording rates R.

Further, in the control example of FIG. 12, the width Wh of the upstream graded segment N4*a* in the fourth nozzle row N4 used to print the final pass process under the first conveying state 911 is smaller than the width Wa of the upstream graded segments in normal pass processes repeated under the first conveying state 911. Therefore, after dots have been formed in an area by nozzles in the upstream graded segment N4*a* of the fourth nozzle row N4 with the final pass process under the first conveying state 911, printing of the area can be completed using a pass process under the second conveying state 912 in which the recording segments of the nozzle row have a small width.

Further, in the control example of FIG. 12 the width Wh of the upstream graded segment N4*a* in the fourth nozzle row N4 for the final process under the first conveying state 911 is equivalent to the width Wh of the downstream graded segment N5*c* in the fifth nozzle row N5 for the initial pass process under the second conveying state 912. Hence, the upstream graded segment N4*a* of the fourth nozzle row N4 and the downstream graded segment N5*c* of the fifth nozzle row N5 can together complete printing in the partial area Bo.

Further, as described with reference to FIGS. 11A-11C, the width of the recording segments for pass processes performed under the second conveying state 912 (the width of the downstream partial region NC, for example) is smaller than the maximum width of recording segments in pass processes performed under the first conveying state 911 (the width of the nozzle area NA, for example). In the example of FIG. 12, the total width of the recording segments N5*b* and N5*c* in the fifth nozzle row N5 used for the fifth pass process under the second conveying state 912 is smaller than the maximum width (Wa+Wb+Wa) of recording segments used under the first conveying state 911. As with the downstream partial region NC in FIG. 11C, the recording segments for each pass process performed in the second conveying state 912 constitute a portion of the nozzle area NA that includes the end of the nozzle area NA on the side of the 218*s* that hold the sheet M. This arrangement can suppress deviations in the ink dot forming positions since deviations in the distance between the sheet M and the nozzles NZ grow smaller toward the downstream rollers 218.

Further, the feed amount F5 for the conveying process performed between the final pass process (the fourth pass process) under the first conveying state 911 and the initial pass process (the fifth pass process) under the second conveying state 912 is the feed amount Ff, which is larger than the feed amount Fa for the normal conveying process repeated under the first conveying state 911. Hence, the printer 600 can transition from the first conveying state 911 shown in FIG. 11A to the second conveying state 912 shown in FIG. 11C while avoiding printing under the state 913 shown in FIG. 11B. Further, a larger area is printed with the first printing process, which has better conveying precision than the second printing process, thereby suppressing banding, including white lines and uneven densities, caused by irregularities in sheet conveying amounts.

Further, in the control example of FIG. 12, the width Wg of the full-recording segment N4*b* in the fourth nozzle row N4 used for the final process under the first conveying state 911 is greater than the width Wb of the full-recording segment for normal pass processes repeated under the first conveying state 911. This arrangement expands the area printed by the full-recording segment N4*b*, that is, the area whose printing is completed during the final pass process under the first conveying state 911. Thus, when transitioning from the first printing process under the first conveying state 911 to the second printing process under the second conveying state 912, this control method can avoid leaving an area whose printing cannot be completed between the first printing process and the second printing process, even when performing a conveying process at the feed amount Ff, which is larger than the normal feed amount Fa repeated under the first conveying state 911.

A-5-3. Fifth Control Example

Figure 13:
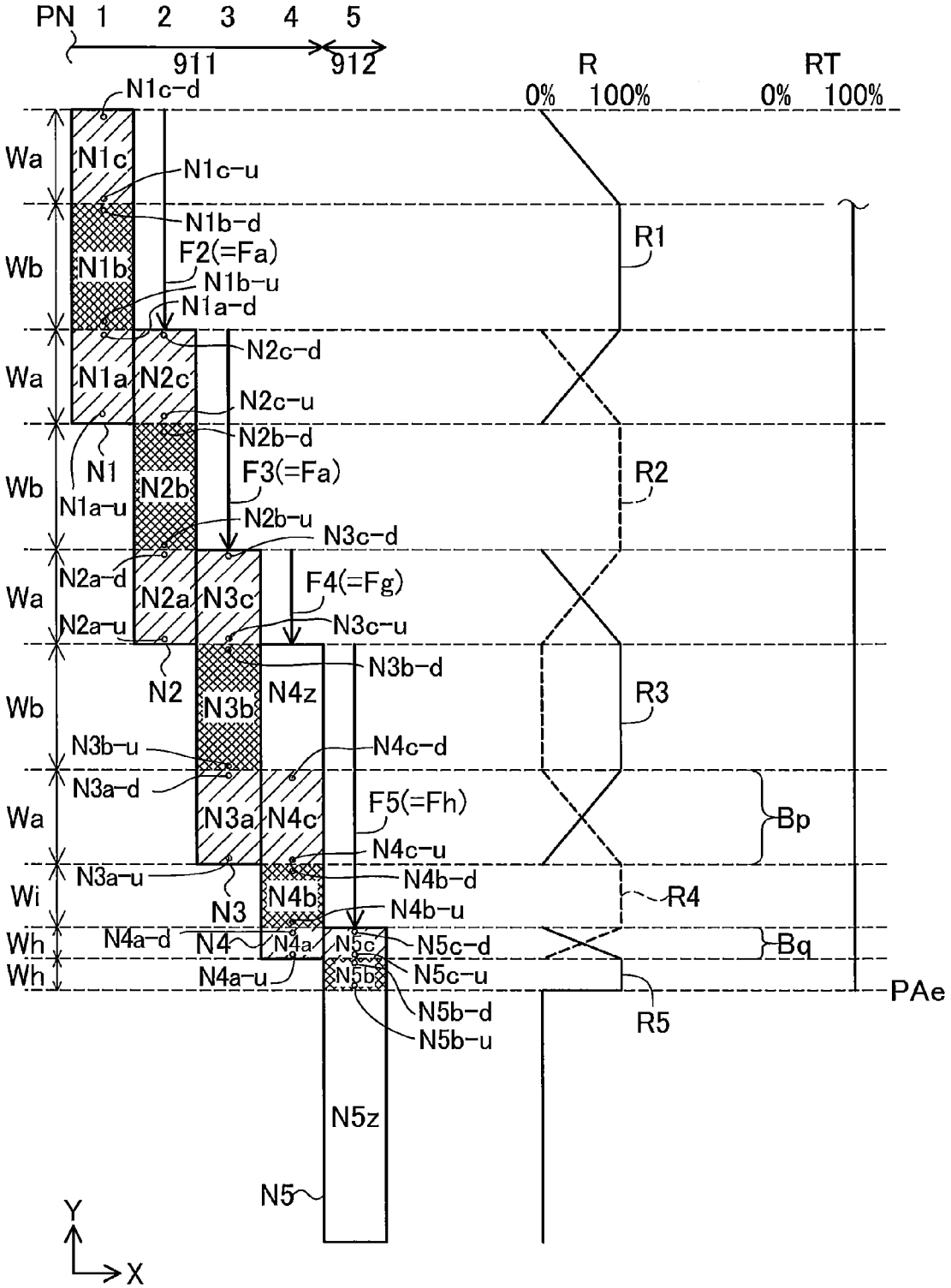
FIG. 13 shows an example of a printing process including a plurality of pass processes according to a fifth embodiment.

FIG. 13 shows another example of pass processes according to a fifth embodiment. The fifth control example according to the fifth embodiment differs from the fourth control example shown in FIG. 12 only in that the recording rate R4 for the fourth nozzle row N4 has been modified. The remaining configuration is identical to the configuration of the control example in FIG. 12.

Next, the recording rate R4 for the fourth nozzle row N4 will be described. The fourth nozzle row N4 is divided into four segments N4*a*, N4*b*, N4*c*, and N4*z* based on the recording rate R4. The segments N4*z* includes the downstream end of the fourth nozzle row N4 and is a non-recording segment (R4=0). The remaining three segments N4*a*, N4*b*, and N4*c* are juxtaposed in the order given toward the downstream side (in the +Y direction) from the upstream end of the fourth nozzle row N4. The width Wh of the upstream graded segment N4*a* is equivalent to the width Wh of the downstream graded segment N5*c* in the fifth nozzle row N5. The width Wi of the full-recording segment N4*b* is smaller than the width Wb of the full-recording segment N3*b* in the third nozzle row N3. The width Wa of the downstream graded segment N4*c* is equivalent to the width Wa of the upstream graded segment N3*a* in the third nozzle row N3. The feed amount F4 used in the conveying process performed prior to the fourth pass process is set so that the downstream graded segment N4*c* in the fourth nozzle row N4 is arranged at the same position as the upstream graded segment N3*a* in the third nozzle row N3 (hereinafter, the feed amount F4 will be called the "feed amount Fg"). Therefore, the downstream graded segment N4*c* of the fourth nozzle row N4 and the upstream graded segment N3*a* of the third nozzle row N3 can form dots in the same partial area Bp on the sheet M. Accordingly, the total recording rate RT is 100% across the entire partial area Bp.

Further, the feed amount F5 used in the conveying process performed after the fourth pass process is set such that the downstream graded segment N5*c* in the fifth nozzle row N5 is arranged at the same position as the upstream graded segment N4*a* in the fourth nozzle row N4. Therefore, the downstream graded segment N5*c* in the fifth nozzle row N5 and the upstream graded segment N4*a* in the fourth nozzle row N4 can form dots in the same partial area Bq on the sheet M. Accordingly, the total recording rate RT is 100% across the entire partial area Bq.

Further, the feed amount F5 for the conveying process performed between the last pass process under the first conveying state 911 (the fourth pass process) and the first pass process under the second conveying state 912 (the fifth pass process) is a feed amount Fh, which is larger than the feed amount Fa used in the normal conveying process that is repeated under the first conveying state 911. Hence, this method can transition from the first conveying state 911 shown in FIG. 11A to the second conveying state 912 shown in FIG. 11C while avoiding printing in state 913 shown in FIG. 11B. Further, by expanding the area printed in the first printing process, which has a higher conveying precision than that of the second printing process, this method can suppress banding, including white lines and uneven printing densities, caused by irregularities in sheet conveying amounts.

As with the control example of FIG. 12, the control example described in FIG. 13 can suitably overlap edge portions of two neighboring bands having non-uniform dot recording rates R.

Further, when forcibly repeating only recording segments of normal widths (Wa+Wb+Wa) and normal feed amounts Fa, a portion of the recording segments in the final pass process of the first printing process may overlap a partial area for which dots are to be formed only in the second printing process. In such cases, it is not possible to perform a large feed between the first printing process and the second printing process. In the control example of FIG. 13, the width of the recording segments in the fourth nozzle row N4 for the final pass process under the first conveying state 911 (N4*a*, N4*b*, and N4*c*) is smaller than the width of the recording segments in normal pass processes repeated under the first conveying state 911 (Wa+Wb+Wa). Hence, this method enables the execution of the large feed amount F5 (Fh) between the first printing process and the second printing process while preventing part of the recording segments in the final pass process of the first printing process from overlapping a partial area in which dots are to be formed only in the second printing process.

While two control examples according to the fourth and fifth embodiments were described above with reference to FIGS. 12 and 13, the print control configurations (the combinations of dot pattern data for each pass process (i.e., the recording rate R) and the feed amount for each conveying process) are predetermined for all supported sheet sizes. When performing single-held printing using a sheet M of a specific size, the processor 110 references the control data PCD in S35 of FIG. 4 to identify the control configuration to be used in single-held printing that has been associated with the specified sheet size and generates print data based on the identified control configuration.

B. Variations of Embodiments (1) Various other control configurations for printing may be used in the present disclosure in addition to the configurations described in FIGS. 8, 9, 10, 12, and 13. For example, the printer 600 may print a region of the sheet M near the upstream edge Pe based on a specific control example while printing a region of the sheet M near the downstream edge according to another control example. Further, three or more pass processes may be performed in the second conveying state 902 illustrated in FIGS. 8, 9, and 10. For example, a process identical to the fourth pass process may be executed between the fourth pass process and fifth pass process in the control examples of FIGS. 8, 9, and 10. Further, the widths of the full-recording segments N4*b* and N5*b* in FIGS. 8 and 9, respectively, may be larger or smaller than the width Wd of the graded segments N4*a*, N4*c*, and N5*c*. Further, two or more pass processes may be performed while in the second conveying state 912 of FIGS. 12 and 13. For example, a pass process identical to the fourth pass process in FIG. 8 or a pass process identical to the fourth pass process in FIG. 10 may be executed between the fourth pass process and fifth pass process in the control examples of FIGS. 12 and 13. In addition, the control examples of FIGS. 12 and 13 may be applied to borderless printing. Similarly, the control examples in FIGS. 8, 9, and 10 may be applied to single-held printing. In any case, conveying precision under the second conveying states 902 and 912 are respectively lower than those under the first conveying states 901 and 911. Consequently, the feed amount used in the second printing process under the second conveying state 902 or 912 is preferably shorter than the normal feed amount used in conveying processes repeatedly performed under the first conveying state 901 or 911. Such configurations can suppress deviations in dot forming positions during the second printing process.

Further, in the upstream graded range, the recording rate R may change so as to describe a curved line or may change in steps in response to changes in the nozzle position in the conveying direction. Similarly, in the downstream graded range the recording rate R may change so as to describe a curved line or may change in steps in response to changes in the nozzle position in the conveying direction.

Further, in at least one of the one or more type 2 pass processes performed in the second printing process (in the second conveying state), the width of the recording segments in the nozzle row (the second distribution width) may be equivalent to the maximum width of the recording segments used in the plurality of type 1 pass processes during the first printing process (in the first conveying state). In this case, at least one of the widths of the upstream graded segment, full-recording segment, and downstream graded segment may be different between the type 1 pass processes and the type 2 pass processes. Further, the width of the recording segments in type 1 pass processes (first distribution width) may be smaller than the maximum value of the width of the recording segments in type 2 pass processes (second distribution width).

Since the width of the overlapping portion between two neighboring band areas becomes smaller when the width of the downstream graded range is small, banding such as white lines and uneven densities tend to be more noticeable. Therefore, the width of the downstream graded range in type 2 pass processes is preferably at least one-third the width of the recording segments (the second distribution width), as in the control examples of FIGS. 8-10, 12, and 13. Further, when the ratio of the width of the downstream graded range to the width of the recording segments is large, it becomes difficult to provide other segments (at least one of the full-recording segment and the upstream graded segment, for example). Therefore, the width of the downstream graded range in type 2 pass processes is preferably no greater than one-half the width of the recording segments (the second distribution width). With this configuration, it is possible to provide other segments having the same width as the downstream graded range (the full-recording segment or upstream graded segment, for example). For example, the widths of the upstream graded range and downstream graded range in the first pass process of the second printing process may each be set to one-half the width of the recording segments, as in the fourth nozzle row N4 in FIG. 10. With this configuration, printing in an area in which the upstream graded segment forms dots during the initial pass process of the second printing process can be appropriately completed using the downstream graded segment in the next pass process, despite the small width of the recording segments in nozzle rows used for the second printing process.

Thus, the width of the upstream graded range for the initial pass process of the second printing process is preferably at least one-third the width of the recording segments, and more preferably no greater than one-half the width of the recording segments (see FIGS. 8-10, 12, and 13, for example). When the nozzle row used in the initial pass process of the second printing process includes a downstream graded segment, the width of the downstream graded range is preferably set to at least one-third the width of the recording segments, and more preferably no greater than one-half the width of the recording segments (see FIGS. 8-10, for example). With this configuration, printing in an area in which dots are formed by the downstream graded segment during the initial pass process of the second printing process can be suitably completed using the upstream graded segment in the next pass process. However, the width of the upstream graded range may be set outside the preferred ranges described above. Similarly, the width of the downstream graded range may also be set outside the preferred ranges described above.

Any of various states may be employed as the first conveying state in place of the states described in FIGS. 7A and 11A. Similarly, any of various conveying states having a lower conveying precision than the first conveying state may be employed as the second conveying state in place of the states described in FIGS. 7B, 11B, and 11C.

In general, the width of the upstream graded range in the final type 1 pass process performed in the first printing process when transitioning from the first printing process to the second printing process is preferably narrower than the normal width of the upstream graded range repeatedly used in type 1 pass processes performed in the first printing process. With this configuration, printing in an area in which nozzles in the upstream graded range form dots during the final type 1 pass process can be suitably completed in a type 2 pass process.

In addition, the control configuration used for printing preferably has the following characteristics. Specifically, in the pluralities of pass processes and conveying processes from the first printing process to the second printing process, the width of the upstream graded segment in a $j^{th}$ pass process (i.e., the number of nozzles) is equivalent to the width of the downstream graded segment in the $j+1^{th}$ pass process. Further, the feed amount of the conveying process performed between the $j^{th}$ pass process and the $j+1^{th}$ pass process is set such that the downstream graded segment in the $j+1^{th}$ pass process is arranged in the same position on the sheet M (the position in the conveying direction) as the position of the upstream graded segment in the $j^{th}$ pass process. The pixel positions at which dot formation is allowed with the downstream graded segment in the $j+1^{th}$ pass process are identical to the pixel positions at which dot formation is prohibited with the upstream graded segment in the $j^{th}$ pass process. With this arrangement, the pass processes can overlap portions of two neighboring band areas while achieving a total recording rate RT of 100% across the entire printing area of the sheet M covered by the first printing process and second printing process. Hence, this arrangement can suppress white lines and uneven densities at borders between neighboring band areas.

(2) Various other structures of the conveying mechanism 210 may be employed in place of the structure shown in FIGS. 3A-3C. For example, a part serving to receive ink rather than to support sheets of paper during the borderless printing described with reference to FIG. 7B may be provided at a position opposing the upstream portion of the nozzle area NA in order to print a region of the sheet near the downstream edge (not shown). Further, the support members 212 and 213 may extend from a position upstream of the nozzle area NA to a position downstream of the nozzle area NA. In this case, borderless printing is omitted. Alternatively, the low support members 213 and pressing members 216 may be omitted.

(3) Any of various printing modes may be provided in the present disclosure in place of the "borderless printing" and "normal printing (single-held printing)" modes of the embodiments. For example, when "normal printing" has been selected, the processor 110 may print the entire printing area by repeating the first pass process and second pass process of FIG. 12 in place of the control examples shown in FIGS. 12 and 13. Alternatively, one of the borderless printing and single-held printing modes may be omitted.

(4) Data based on which the printing control configuration can be derived may be used as the control data PCD in place of data representing all printing control configurations for each of the one or more possible combinations of sheet size and printing mode. In this case, in S35 of FIG. 4 the processor 110 may derive the control configuration for printing according to an algorithm correlated with the selected combination of sheet size and printing mode using this base data.

(5) The print execution unit may be configured in various other ways in place of the configuration of the printing mechanism 200 described in FIGS. 1-3. For example, the types of ink that can be used in printing are not limited to the CMYK ink colors, but may be one or more of any of various ink types.

(6) The control unit 100 in FIG. 1 may be a standalone device rather than a device built into the printer 600, such as a smartphone or a personal computer. Further, a plurality of devices that can communicate over a network (computers, for example) may each implement a portion of the functions of the control process executed by a control device so that the devices as a whole can provide the functions required to implement the control process. Here, the system comprising the devices corresponds to the control device. In any case, a processor that generates print data by which a print execution unit executes the first printing process may be used as a controller or processor for controlling the print execution unit to implement the first printing process. Similarly, a processor that generates print data by which the print execution unit executes the second printing process may be used as a controller or processor for controlling the print execution unit to implement the second printing process.

In the first to fifth embodiments described above, part of the configuration implemented in hardware may be replaced with software and, conversely, all or part of the configuration implemented in software may be replaced with hardware. For example, a dedicated hardware circuit may be provided to execute the functions of the processor 110 in FIG. 1 (the function for generating print data, for example).

When all or some of the functions of the present disclosure are implemented with computer programs, the programs can be stored on a computer-readable storage medium (a non-temporary storage medium, for example). The programs may be used on the same storage medium on which they were supplied, or may be transferred to a different storage medium (computer-readable storage medium). The "computer-readable storage medium" may be a portable storage medium, such as a memory card or CD-ROM; an internal storage device built into the computer, such as any of various ROM or the like; or an external storage device, such as a hard disk drive, connected to the computer.

While the description has been made in detail with reference to specific embodiments and variations thereof, it would be apparent to those skilled in the art that various changes and modifications may be made therein without departing from the spirit and scope of the present disclosure.

What is claimed is:

1. A printer comprising:

a print executing unit including:

a conveying mechanism configured to convey a sheet in a conveying direction;

a print head having a plurality of nozzles arranged in the conveying direction, each of the plurality of nozzles being configured to eject an ink droplet to form a dot on the sheet; and a main scanning mechanism configured to execute a main scan by moving the print head in a main scanning direction perpendicular to the conveying direction; and a controller configured to control the print executing unit to perform a multi-pass printing for printing a target image on the sheet with a plurality of pass processes, the plurality of pass processes forming a plurality of partial images respectively, two partial images formed with successive two pass processes overlapping partially, and K number of active nozzles consecutively arranged being selected from the plurality of nozzles for each of the plurality of pass processes, wherein the controller is further configured to control the print executing unit to perform:

an (a)-print process in which the conveying mechanism conveys the sheet and at least two pass processes are executed with Ka number of active nozzles, wherein the at least two pass processes include:

an (a1)-pass process with Ka1 number of active nozzles as the Ka number of active nozzles, the Ka1 number of active nozzles including a first upstream segment, a first downstream segment, and a first intermediate segment between the first upstream segment and the first downstream segment in the conveying direction, the first upstream segment including a most-upstream nozzle of the Ka1 number of active nozzles in the conveying direction, the first downstream segment including a most-downstream nozzle of the Ka1 number of active nozzles in the conveying direction, dot recording rates of active nozzles included in the first upstream segment decreasing from a most-downstream nozzle of the first upstream segment toward the most-upstream nozzle of the Ka1 number of active nozzles, the first downstream segment having a length same as a length of the first upstream segment, dot recording rates of active nozzles included in the first downstream segment decreasing from a most-upstream nozzle of the first downstream segment toward the most-downstream nozzle of the Ka1 number of active nozzles, and dot recording rate of each active nozzle included in the first intermediate segment being 100%; and an (a2)-pass process with Ka2 number of active nozzles as the Ka number of active nozzles, the (a2)-pass process being a last pass process executed in the (a)-print process and executed after the (a1)-pass process, the Ka2 number of active nozzles including a second upstream segment, a second downstream segment, and a second intermediate segment between the second upstream segment and the second downstream segment in the conveying direction, the second upstream segment including a most-upstream nozzle of the Ka2 number of active nozzles in the conveying direction, the second downstream segment including a most-downstream nozzle of the Ka2 number of active nozzles in the conveying direction, dot recording rates of active nozzles included in the second upstream segment decreasing from a most-downstream nozzle of the second upstream segment toward the most-upstream nozzle of the Ka2 number of active nozzles, dot recording rates of active nozzles included in the second downstream segment decreasing from a most-upstream nozzle of the second downstream segment toward the most-downstream nozzle of the Ka2 number of active nozzles, the second downstream segment of the Ka2 number of active nozzles having a length same as the length of the first upstream segment of the Ka1 number of active nozzles used in the (a1)-pass process, the second upstream segment of the Ka2 number of active nozzles having a length smaller than the length of the first upstream segment of the Ka1 number of active nozzles used in the (a1)-pass process, and dot recording rate of each active nozzle included in the second intermediate segment being 100%; and a (b)-print process in which the conveying mechanism conveys the sheet and executed with Kb number of active nozzles, the (b)-print process being executed after the (a2)-pass process, the Kb number of active nozzles including a third downstream segment including a most-downstream nozzle of the Kb number of active nozzles in the conveying direction, and dot recording rates of active nozzles included in the third downstream segment decreasing from a most-upstream nozzle of the third downstream segment toward the most-downstream nozzle of the Kb number of active nozzles.

2. The printer according to claim 1, wherein the controller is further configured to control the print executing unit to perform:

conveying the sheet a first amount before the (a1)-pass process; and conveying the sheet a second amount between the (a2)-pass process and an initial pass process executed in the (b)-print process when transition from the (a)-print process to the (b)-print process is performed, the second amount being greater than the first amount.

3. The printer according to claim 1, wherein the conveying mechanism includes:

an upstream holding unit configured to hold the sheet at a position upstream from the print head in the conveying direction; and a downstream holding unit configured to hold the sheet at a position downstream from the print head in the conveying direction, wherein the sheet is held under a first state during execution of the (a)-print process, the first state being a state under which the sheet is held by the upstream holding unit and the downstream holding unit, and wherein the sheet is held under a second state during execution of the (b)-print process, the second state being a state under which the sheet is not held by the upstream holding unit and is held by the downstream holding unit.

4. The printer according to claim 3, wherein the length of the second upstream segment of the Ka2 number of active nozzles used in the (a2)-pass process is equal to a length of the downstream segment of the Kb number of active nozzles used in an initial pass process executed in the (b)-print process.

5. The printer according to claim 1, wherein the Ka1 number of active nozzles has a first length, wherein the Kb number of active nozzles has a second length smaller than the first length.

6. The printer according to claim 5, wherein a length of the third downstream segment of the Kb number of active nozzles is greater than or equal to one-third of the second length.

7. The printer according to claim 5, wherein a length of the third downstream segment of the Kb number of active nozzles is smaller than or equal to one-half of the second length, and wherein the Kb number of active nozzles further includes a third upstream segment, the third upstream segment including a most-upstream nozzle of the Kb number of active nozzles in the conveying direction, dot recording rates of active nozzles included in the third upstream segment decreasing from a most-downstream nozzle of the third upstream segment toward the most-upstream nozzle of the Kb number of active nozzles, and the second upstream segment having a length smaller than or equal to one-half of the second length.

8. The printer according to claim 7, wherein each of the length of the third downstream segment of the Kb number of active nozzles and the length of the third upstream segment of the Kb number of active nozzles is one-half of the second length.

9. A non-transitory computer readable storage medium storing a set of program instructions executable by a processor, the program instructions, when executed by the processor, causing the processor to control a print executing apparatus to perform a multi-pass printing, the print executing apparatus including a conveying mechanism, a print head, and a main scanning mechanism, the conveying mechanism being configured to convey a sheet in a conveying direction, the print head having a plurality of nozzles arranged in the conveying direction, each of the plurality of nozzles being configured to eject an ink droplet to form a dot on the sheet, the main scanning mechanism configured to execute a main scan by moving the print head in a main scanning direction perpendicular to the conveying direction, the processor being configured to control the print executing apparatus to perform the multi-pass printing for printing a target image on the sheet with a plurality of pass processes, the plurality of pass processes forming a plurality of partial images respectively, two partial images formed with successive two pass processes overlapping partially, and K number of active nozzles consecutively arranged being selected from the plurality of nozzles for each of the plurality of pass processes, wherein the processor is further configured to control the print executing unit to perform:

an (a)-print process in which the conveying mechanism conveys the sheet and at least two pass processes are executed with Ka number of active nozzles, wherein the at least two pass processes include:

an (a1)-pass process with Ka1 number of active nozzles as the Ka number of active nozzles, the Ka1 number of active nozzles including a first upstream segment, a first downstream segment, and a first intermediate segment between the first upstream segment and the first downstream segment in the conveying direction, the first upstream segment including a most-upstream nozzle of the Ka1 number of active nozzles in the conveying direction, the first downstream segment including a most-downstream nozzle of the Ka1 number of active nozzles in the conveying direction, dot recording rates of active nozzles included in the first upstream segment decreasing from a most-downstream nozzle of the first upstream segment toward the most-upstream nozzle of the Ka1 number of active nozzles, the first downstream segment having a length same as a length of the first upstream segment, and dot recording rates of active nozzles included in the first downstream segment decreasing from a most-upstream nozzle of the first downstream segment toward the most-downstream nozzle of the Ka1 number of active nozzles, dot recording rate of each active nozzle included in the first intermediate segment being 100%; and an (a2)-pass process with Ka2 number of active nozzles as the Ka number of active nozzles, the (a2)-pass process being a last pass process executed in the (a)-print process and executed after the (a1)-pass process, the Ka2 number of active nozzles including a second upstream segment, a second downstream segment, and a second intermediate segment between the second upstream segment and the second downstream segment in the conveying direction, the second upstream segment including a most-upstream nozzle of the Ka2 number of active nozzles in the conveying direction, the second downstream segment including a most-downstream nozzle of the Ka2 number of active nozzles in the conveying direction, dot recording rates of active nozzles included in the second upstream segment decreasing from a most-downstream nozzle of the second upstream segment toward the most-upstream nozzle of the Ka2 number of active nozzles, dot recording rates of active nozzles included in the second downstream segment decreasing from a most-upstream nozzle of the second downstream segment toward the most-downstream nozzle of the Ka2 number of active nozzles having a length same as the length of the first upstream segment of the Ka1 number of active nozzles used in the (a1)-pass process, the second upstream segment of the Ka2 number of active nozzles having a length smaller than the length of the first upstream segment of the Ka1 number of active nozzles used in the (a1)-pass process, and dot recording rate of each active nozzle included in the second intermediate segment being 100%; and a (b)-print process in which the conveying mechanism conveys the sheet and executed with Kb number of active nozzles, the (b)-print process being executed after the (a2)-pass process, the Kb number of active nozzles including a third downstream segment including a most-downstream nozzle of the Kb number of active nozzles in the conveying direction, and dot recording rates of active nozzles included in the third downstream segment decreasing from a most-upstream nozzle of the third downstream segment toward the most-downstream nozzle of the Kb number of active nozzles.

* * * * *